US009569960B2

(12) United States Patent
Xu et al.

(10) Patent No.: US 9,569,960 B2
(45) Date of Patent: Feb. 14, 2017

(54) METHOD AND APPARATUS FOR PROVIDING TRAFFIC JAM DETECTION AND PREDICTION

(71) Applicant: HERE Global B.V., Veldhoven (NL)

(72) Inventors: Bo Xu, Lisle, IL (US); Jane MacFarlane, Oakland, CA (US)

(73) Assignee: HERE GLOBAL B.V., Voldhoven (NL)

( * ) Notice: Subject to any disclaimer, the term of this patent is extended or adjusted under 35 U.S.C. 154(b) by 0 days.

(21) Appl. No.: 14/629,628

(22) Filed: Feb. 24, 2015

(65) Prior Publication Data

US 2016/0247397 A1 Aug. 25, 2016

(51) Int. Cl.
*G08G 1/01* (2006.01)
*G08G 1/052* (2006.01)

(52) U.S. Cl.
CPC ..... *G08G 1/0125* (2013.01); *G08G 1/0141* (2013.01); *G08G 1/052* (2013.01)

(58) Field of Classification Search
USPC ..... 701/117, 118, 119, 414, 465, 532, 533, 701/79; 342/454
See application file for complete search history.

(56) References Cited

U.S. PATENT DOCUMENTS 6,061,625 A * 5/2000 Fastenrath ..... G08G 1/0104 342/454
6,546,330 B2 * 4/2003 Fushiki ..... G08G 1/0104 701/118

(Continued)

FOREIGN PATENT DOCUMENTS

DE 102012204123 A1 9/2013
DE 102013010321 A1 12/2013

(Continued)

OTHER PUBLICATIONS

Hofleitner et al., "Learning the Dynamics of Arterial Traffic From Probe Data Using a Dynamic Bayesian Network", IEEE Transactions on Intelligent Transportation Systems, May 11, 2012, pp. 1-15.

*Primary Examiner* — Thomas Tarcza
*Assistant Examiner* — Richard Goldman
(74) *Attorney, Agent, or Firm* — Ditthavong & Steiner, P.C.

(57) ABSTRACT

An approach is provided for predicting starting points and/or ending points for traffic jams in one or more travel segments. The approach involves processing and/or facilitating a processing of probe data associated with at least one travel segment to cause, at least in part, a generation of at least one speed curve with respect to a distance dimension and a time dimension, wherein the probe data includes speed information, and wherein the at least one speed curve indicates at least one previous starting point, at least one previous ending point, or a combination thereof for one or more previous traffic jams based, at least in part, on the speed information. The approach also involves processing and/or facilitating a processing of the at least one previous starting point, the at least one previous ending point, or a combination thereof to determine at least one starting point trend curve, at least one ending point trend curve, or a combination thereof with respect to the distance dimension and the time dimension. The approach further involves determining at least one predicted evolution of at least one starting point, at least one ending point, or a combination thereof for at least one traffic jam in the at least one travel segment based, at least in part, on the at least one starting point trend curve, the at least one ending point trend curve, or a combination thereof.

20 Claims, 19 Drawing Sheets

(56) References Cited

U.S. PATENT DOCUMENTS

| | | | | |
|---|---|---|---|---|
| 6,721,650 | B2 * | 4/2004 | Fushiki | G08G 1/0104 701/118 |
| 7,680,588 | B2 * | 3/2010 | Tsukamoto | G08G 1/0104 701/117 |
| 7,739,040 | B2 * | 6/2010 | Horvitz | G01C 21/3492 701/414 |
| 7,953,544 | B2 * | 5/2011 | Amemiya | G08G 1/0104 340/995.13 |
| 8,290,695 | B2 * | 10/2012 | Hiestermann | G01C 21/32 15/42 |
| 2008/0294331 | A1 * | 11/2008 | Fushiki | G08G 1/0104 701/119 |
| 2013/0041574 | A1 * | 2/2013 | Koshizen | G08G 1/0112 701/118 |
| 2013/0245945 | A1 * | 9/2013 | Morita | G08G 1/096716 701/533 |

FOREIGN PATENT DOCUMENTS

| | | | |
|---|---|---|---|
| EP | 1057156 | B1 | 12/2000 |
| EP | 1061491 | A1 | 12/2000 |
| EP | 1644271 | A1 | 7/2006 |
| JP | 2009236567 | A | 10/2009 |
| WO | 2014091982 | A1 | 6/2014 |

* cited by examiner

600

700

900

METHOD AND APPARATUS FOR PROVIDING TRAFFIC JAM DETECTION AND PREDICTION

BACKGROUND

Traffic jams take place all the time, resulting in travel delays. The costs of travel delays can be significant, hence navigation systems that assist vehicle users to optimize their travel by notifying them on traffic situations well-in-advance are of significant value. However, computing recurrence of traffic jams beforehand is challenging because traffic networks are dynamic and the determination must be made in real-time. As a result, service providers and device manufacturers (e.g., wireless, cellular, etc.) are continually challenged to deliver value and convenience to consumers by, for example, providing a service that determines a starting point, an ending point, and the duration for future traffic jams.

SOME EXAMPLE EMBODIMENTS

Therefore, there is a need for an approach for predicting starting points and/or ending points for traffic jams in one or more travel segments.

According to one embodiment, a method comprises processing and/or facilitating a processing of probe data associated with at least one travel segment to cause, at least in part, a generation of at least one speed curve with respect to a distance dimension and a time dimension, wherein the probe data includes speed information, and wherein the at least one speed curve indicates at least one previous starting point, at least one previous ending point, or a combination thereof for one or more previous traffic jams based, at least in part, on the speed information. The method also comprises processing and/or facilitating a processing of the at least one previous starting point, the at least one previous ending point, or a combination thereof to determine at least one starting point trend curve, at least one ending point trend curve, or a combination thereof with respect to the distance dimension and the time dimension. The method further comprises determining at least one predicted evolution or change of at least one starting point, at least one ending point, or a combination thereof for at least one traffic jam in the at least one travel segment based, at least in part, on the at least one starting point trend curve, the at least one ending point trend curve, or a combination thereof.

According to another embodiment, an apparatus comprises at least one processor, and at least one memory including computer program code for one or more computer programs, the at least one memory and the computer program code configured to, with the at least one processor, cause, at least in part, the apparatus to process and/or facilitate a processing of probe data associated with at least one travel segment to cause, at least in part, a generation of at least one speed curve with respect to a distance dimension and a time dimension, wherein the probe data includes speed information, and wherein the at least one speed curve indicates at least one previous starting point, at least one previous ending point, or a combination thereof for one or more previous traffic jams based, at least in part, on the speed information. The apparatus is also caused to processing and/or facilitating a processing of the at least one previous starting point, the at least one previous ending point, or a combination thereof to determine at least one starting point trend curve, at least one ending point trend curve, or a combination thereof with respect to the distance dimension and the time dimension. The apparatus is further caused to determine at least one predicted evolution or change of at least one starting point, at least one ending point, or a combination thereof for at least one traffic jam in the at least one travel segment based, at least in part, on the at least one starting point trend curve, the at least one ending point trend curve, or a combination thereof.

According to another embodiment, a computer-readable storage medium carries one or more sequences of one or more instructions which, when executed by one or more processors, cause, at least in part, an apparatus to process and/or facilitate a processing of probe data associated with at least one travel segment to cause, at least in part, a generation of at least one speed curve with respect to a distance dimension and a time dimension, wherein the probe data includes speed information, and wherein the at least one speed curve indicates at least one previous starting point, at least one previous ending point, or a combination thereof for one or more previous traffic jams based, at least in part, on the speed information. The apparatus is also caused to process and/or facilitate a processing of the at least one previous starting point, the at least one previous ending point, or a combination thereof to determine at least one starting point trend curve, at least one ending point trend curve, or a combination thereof with respect to the distance dimension and the time dimension. The apparatus is further caused to determining at least one predicted evolution or change of at least one starting point, at least one ending point, or a combination thereof for at least one traffic jam in the at least one travel segment based, at least in part, on the at least one starting point trend curve, the at least one ending point trend curve, or a combination thereof.

According to another embodiment, an apparatus comprises means for processing and/or facilitating a processing of probe data associated with at least one travel segment to cause, at least in part, a generation of at least one speed curve with respect to a distance dimension and a time dimension, wherein the probe data includes speed information, and wherein the at least one speed curve indicates at least one previous starting point, at least one previous ending point, or a combination thereof for one or more previous traffic jams based, at least in part, on the speed information. The apparatus also comprises means for processing and/or facilitating a processing of the at least one previous starting point, the at least one previous ending point, or a combination thereof to determine at least one starting point trend curve, at least one ending point trend curve, or a combination thereof with respect to the distance dimension and the time dimension. The apparatus further comprises means for determining at least one predicted evolution or change of at least one starting point, at least one ending point, or a combination thereof for at least one traffic jam in the at least one travel segment based, at least in part, on the at least one starting point trend curve, the at least one ending point trend curve, or a combination thereof.

In addition, for various example embodiments of the invention, the following is applicable: a method comprising facilitating a processing of and/or processing (1) data and/or (2) information and/or (3) at least one signal, the (1) data and/or (2) information and/or (3) at least one signal based, at least in part, on (or derived at least in part from) any one or any combination of methods (or processes) disclosed in this application as relevant to any embodiment of the invention.

For various example embodiments of the invention, the following is also applicable: a method comprising facilitating access to at least one interface configured to allow access to at least one service, the at least one service configured to perform any one or any combination of network or service provider methods (or processes) disclosed in this application.

For various example embodiments of the invention, the following is also applicable: a method comprising facilitating creating and/or facilitating modifying (1) at least one device user interface element and/or (2) at least one device user interface functionality, the (1) at least one device user interface element and/or (2) at least one device user interface functionality based, at least in part, on data and/or information resulting from one or any combination of methods or processes disclosed in this application as relevant to any embodiment of the invention, and/or at least one signal resulting from one or any combination of methods (or processes) disclosed in this application as relevant to any embodiment of the invention.

For various example embodiments of the invention, the following is also applicable: a method comprising creating and/or modifying (1) at least one device user interface element and/or (2) at least one device user interface functionality, the (1) at least one device user interface element and/or (2) at least one device user interface functionality based at least in part on data and/or information resulting from one or any combination of methods (or processes) disclosed in this application as relevant to any embodiment of the invention, and/or at least one signal resulting from one or any combination of methods (or processes) disclosed in this application as relevant to any embodiment of the invention.

In various example embodiments, the methods (or processes) can be accomplished on the service provider side or on the mobile device side or in any shared way between service provider and mobile device with actions being performed on both sides.

For various example embodiments, the following is applicable: An apparatus comprising means for performing a method of any of the claims.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings.

DESCRIPTION OF SOME EMBODIMENTS

Examples of a method, apparatus, and computer program for predicting starting points and/or ending points for traffic jams in one or more travel segments are disclosed. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in block diagram form in order to avoid unnecessarily obscuring the embodiments of the invention. Although various embodiments are described with respect to predicting traffic jams in travel segments, it is contemplated that the approach described herein may be used to predict traffic jams in other situations (e.g., waterways, railways, airways, etc.).

Figure 1:
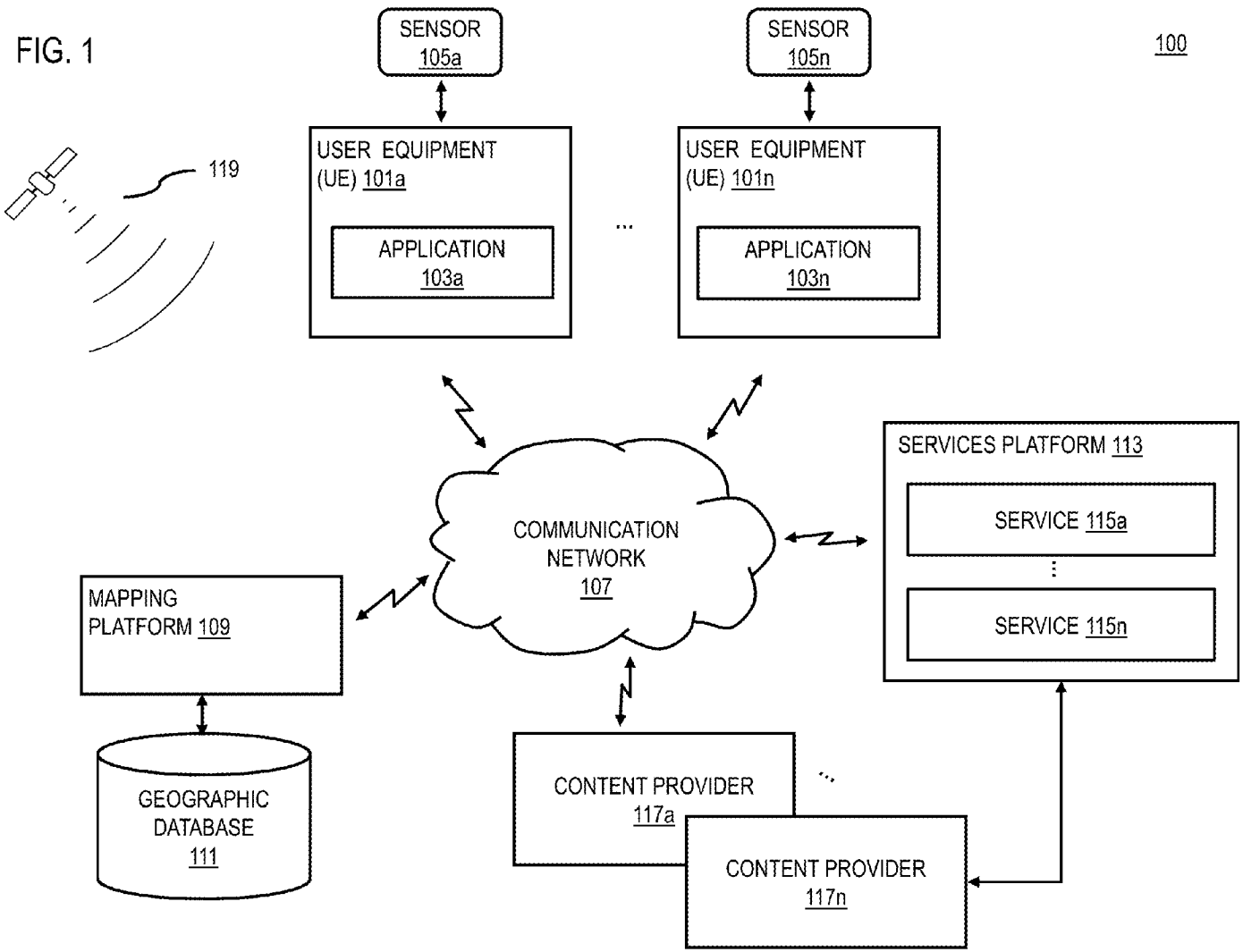
FIG. 1 is a diagram of a system capable of predicting starting points and/or ending points for traffic jams in one or more travel segments, according to one embodiment.

FIG. 1 is a diagram of a system capable of predicting starting points and/or ending points for traffic jams in one or more travel segments, according to one embodiment. Vehicles are impeding each other's progression as physical capacity of travel segments is approaching full capacity. Such traffic jams prevent users from moving freely and disrupts their travel plans. Further, the users may encounter higher vehicle operating costs. Hence, well-timed notifications on traffic conditions are important in order to avoid traffic jams and minimize the time spent in operating the motor vehicle. An advance warning is preferred so the users can avoid the area where the traffic jam situation exists.

To address this problem, a system 100 of FIG. 1 introduces the capability to detect start location and/or end location for traffic jams using speed-distance curve. The system 100 may detect traffic jams by observing the slope of velocity versus distance. The system 100 may use the slope data to predict when and where future traffic jams will start and end, and how long the traffic jam will last in regards to distance and/or time. The system 100 may implement this function in real-time. In one embodiment, the system 100 may detect a duration for future traffic jams using a prediction curve that tracks start locations and/or end locations for traffic jams at future time. In one scenario, the system 100 may programmatically detect traffic jams regardless of whether they are short term disturbances or long term congestions. For example, a traffic jam may be a situation in which the traffic speed is lower than a certain threshold (e.g., jam threshold). In a further embodiment, the system 100 may detect traffic jams online, for instance, at any point in time the system 100 may observe probe data that has been received up to that time. Then, the system 100 may detect traffic jam information, and may report the start location (i.e., where the jam starts to form) and end location (i.e., where the traffic starts to recover to normal speed).

As shown in FIG. 1, the system 100 comprises user equipment (UE) 101*a*-101*n* (collectively referred to as UE 101) that may include or be associated with applications 103*a*-103*n* (collectively referred to as applications 103) and sensors 105*a*-105*n* (collectively referred to as sensors 105). In one embodiment, the UE 101 has connectivity to a mapping platform 109 via the communication network 107. In one embodiment, the mapping platform 109 performs one or more functions associated with predicting starting points and/or ending points for traffic jams in one or more travel segments.

By way of example, the UE 101 is any type of mobile terminal, fixed terminal, or portable terminal including a mobile handset, station, unit, device, multimedia computer, multimedia tablet, Internet node, communicator, desktop computer, laptop computer, notebook computer, netbook computer, tablet computer, personal communication system (PCS) device, personal navigation device, personal digital assistants (PDAs), audio/video player, digital camera/camcorder, positioning device, fitness device, television receiver, radio broadcast receiver, electronic book device, game device, or any combination thereof, including the accessories and peripherals of these devices, or any combination thereof. It is also contemplated that the UE 101 can support any type of interface to the user (such as "wearable" circuitry, etc.). In one embodiment, the UE 101 may be a vehicle (e.g., cars), a mobile device (e.g., phone), and/or a combination of the two.

By way of example, the applications 103 may be any type of application that is executable at the UE 101, such as mapping application, location-based service applications, navigation applications, content provisioning services, camera/imaging application, media player applications, social networking applications, calendar applications, and the like. In one embodiment, one of the applications 103 at the UE 101 may act as a client for the mapping platform 109 and perform one or more functions associated with the functions of the mapping platform 109 by interacting with the mapping platform 109 over the communication network 107. In one scenario, applications 103 may interface with the sensors 105 and/or the services platform 113 via the communication network 107 for determining speed information for one or more vehicles, speed limit information for the one or more road links, or a combination thereof.

By way of example, the sensors 105 may be any type of sensor. In certain embodiments, the sensors 105 may include, for example, a global positioning sensor for gathering location data (e.g., GPS), a network detection sensor for detecting wireless signals or receivers for different short-range communications (e.g., Bluetooth, Wi-Fi, Li-Fi, near field communication (NFC) etc.), temporal information sensors, a camera/imaging sensor for gathering image data (e.g., the camera sensors may automatically capture obstruction for analysis and documentation purposes), an audio recorder for gathering audio data, velocity sensors mounted on steering wheels of the vehicles, and the like. In another embodiment, the sensors 105 may include light sensors, oriental sensors augmented with height sensor and acceleration sensor (e.g., an accelerometer can measure acceleration and can be used to determine orientation of the vehicle), tilt sensors to detect the degree of incline or decline of the vehicle along a path of travel, moisture sensors, pressure sensors, etc. In a further example embodiment, sensors about the perimeter of the vehicle may detect the relative distance of the vehicle from lane or roadways, the presence of other vehicles, pedestrians, traffic lights, potholes and any other objects, or a combination thereof. In one scenario, the sensors 105 may detect weather data, traffic information, or a combination thereof. In one example embodiment, the UE 101 may include GPS receivers to obtain geographic coordinates from satellites 119 for determining current location and time associated with the UE 101 and/or a vehicle. Further, the location can be determined by a triangulation system such as A-GPS, Cell of Origin, or other location extrapolation technologies. In another example embodiment, the one or more sensors may provide in-vehicle navigation services, wherein one or more location based services may be provided to the at least one UE 101 associated with the at least one user of the vehicle and/or at least one other UE 101 associated with the at least one vehicle.

The communication network 107 of system 100 includes one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (Wi-Fi), wireless LAN (WLAN), Bluetooth®, Internet Protocol (IP) data casting, satellite, mobile ad-hoc network (MANET), and the like, or any combination thereof.

In one embodiment, the mapping platform 109 may be a platform with multiple interconnected components. The mapping platform 109 may include multiple servers, intelligent networking devices, computing devices, components and corresponding software for predicting starting points and/or ending points for traffic jams in one or more travel segments. In addition, it is noted that the mapping platform 109 may be a separate entity of the system 100, a part of the one or more services 115*a*-115*n* (collectively referred to as services 115) of the services platform 113, or included within the UE 101 (e.g., as part of the applications 103).

In one embodiment, the mapping platform 109 detects start location and/or end location for a traffic jam, and its duration (i.e., how long it will last). The mapping platform 109 may divide a stretch of road into sections (e.g., m sections) and may collect probe data for each section in a particular time frame. In one scenario, the average of probe data for a particular section may denote the average speed of vehicles on the section. Then, the mapping platform 109 may plot a curve between the speed and the distance dimension of sections. In such manner, the mapping platform 109 tracks the changes in the speed curve and detects multiple points where the speed rises (or falls) above (or below) a certain threshold level. In one scenario, if the speed curve drops below the jam threshold, the mapping platform 109 may determine it to be a start location for a traffic jam. In another scenario, sections where the speed curve becomes higher than the jam threshold for certain consecutive cells (let say n), the mapping platform 109 may determine the n-th section as the end location for a traffic jam. Subsequently, the mapping platform 109 may predict the duration of the traffic jam. In another embodiment, the mapping platform 109 may continuously track start locations of traffic jams (using linear regression) to generate a trend curve (time versus distance) to predict future location of start point of traffic jam after certain time (e.g., t). If the distance between the actual location of start point of traffic jam at certain time and curve predicted location is not significant (e.g., t1 where t1>t) then curve is adjusted to include actual start location otherwise prediction procedure stops as it indicates the traffic jam starts to recover.

In one embodiment, the geographic database 111 may store speed information for one or more vehicles, speed limit for one or more road links, traffic jam threshold for one or more road links, distance information for one or more road links, velocity information for one or more road links, or a combination thereof. The information may be any multiple types of information that can provide means for aiding in the content provisioning and sharing process.

The services platform 113 may include any type of service. By way of example, the services platform 113 may include mapping services, navigation services, travel planning services, notification services, social networking services, content (e.g., audio, video, images, etc.) provisioning services, application services, storage services, contextual information determination services, location based services, information (e.g., weather, news, etc.) based services, etc. In one embodiment, the services platform 113 may interact with the UE 101, the mapping platform 109 and the content provider 117 to supplement or aid in the processing of the content information.

By way of example, the services 115 may be an online service that reflects interests and/or activities of users. In one scenario, the services 115 may provide information on humanized speed for at least one user and a variety of additional information. The services 115 allow users to share location information, activities information (e.g., speed information), contextual information, historical user information and interests within their individual networks, and provides for data portability. The services 115 may additionally assist in providing the mapping platform 109 with information on travel plans of at least one user, speed information for at least one user, user profile information, etc.

The content providers 117*a*-117*n* (collectively referred to as content provider 117) may provide content to the UE 101, the mapping platform 109, and the services 115 of the services platform 113. The content provided may be any type of content, such as textual content, audio content, video content, image content, etc. In one embodiment, the content provider 117 may provide content that may supplement content of the applications 103, the sensors 105, or a combination thereof. By way of example, the content provider 117 may provide content that may aid in the processing of speed information for at least one vehicle, speed limit for at least one road link, traffic jam threshold for at least one road link, or a combination thereof. In one embodiment, the content provider 117 may also store content associated with the UE 101, the mapping platform 109, and the services 115 of the services platform 113. In another embodiment, the content provider 117 may manage access to a central repository of data, and offer a consistent, standard interface to data, such as a repository of speed limit for one or more road links, speed information for at least one vehicle, traffic jam threshold for at least one road link, other traffic information, etc. Any known or still developing methods, techniques or processes for retrieving and/or accessing features for road links from one or more sources may be employed by the mapping platform 109.

By way of example, the UE 101, the mapping platform 109, the services platform 113, and the content provider 117 communicate with each other and other components of the communication network 107 using well known, new or still developing protocols. In this context, a protocol includes a set of rules defining how the network nodes within the communication network 107 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

Figure 2:
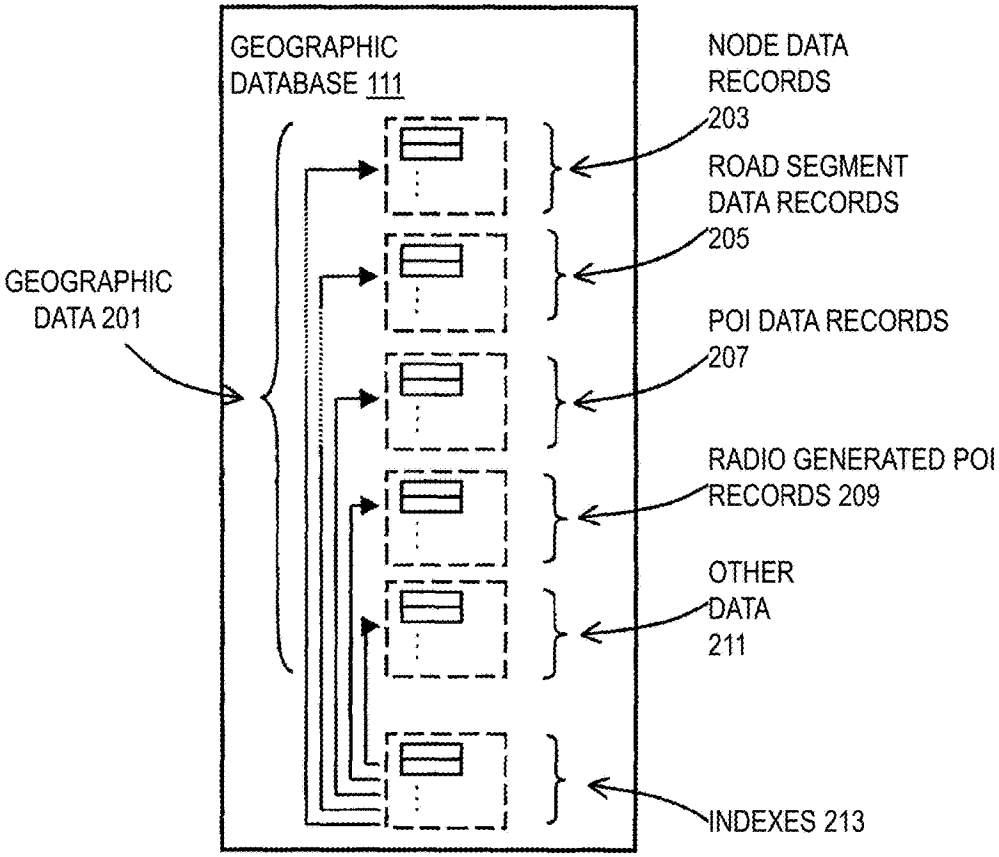
FIG. 2 is a diagram of the geographic database 111 of system 100, according to exemplary embodiments.

FIG. 2 is a diagram of the geographic database 111 of system 100, according to exemplary embodiments. In the exemplary embodiments, POIs and map generated POIs data can be stored, associated with, and/or linked to the geographic database 111 or data thereof. In one embodiment, the geographic database 111 includes geographic data 201 used for (or configured to be compiled to be used for) mapping and/or navigation-related services, such as for personalized route determination, according to exemplary embodiments. For example, the geographic database 111 includes node data records 203, road segment or link data records 205, POI data records 207, radio generated POI records 209, and other data records 211, for example. More, fewer or different data records can be provided. In one embodiment, the other data records 211 include cartographic ("carto") data records, routing data, and maneuver data. One or more portions, components, areas, layers, features, text, and/or symbols of the POI or event data can be stored in, linked to, and/or associated with one or more of these data records. For example, one or more portions of the POI, event data, or recorded route information can be matched with respective map or geographic records via position or GPS data associations (such as using known or future map matching or geo-coding techniques), for example.

In exemplary embodiments, the road segment data records 205 are links or segments representing roads, streets, or paths, as can be used in the calculated route or recorded route information for determination of one or more personalized routes, according to exemplary embodiments. The node data records 203 are end points corresponding to the respective links or segments of the road segment data records 205. The road link data records 205 and the node data records 203 represent a road network, such as used by vehicles, cars, and/or other entities. Alternatively, the geographic database 111 can contain path segment and node data records or other data that represent pedestrian paths or areas in addition to or instead of the vehicle road record data, for example.

The road/link segments and nodes can be associated with attributes, such as geographic coordinates, street names, address ranges, speed limits, turn restrictions at intersections, and other navigation related attributes, as well as POIs, such as gasoline stations, hotels, restaurants, museums, stadiums, offices, automobile dealerships, auto repair shops, buildings, stores, parks, etc. The geographic database 111 can include data about the POIs and their respective locations in the POI data records 207. The geographic database 111 can also include data about places, such as cities, towns, or other communities, and other geographic features, such as bodies of water, mountain ranges, etc. Such place or feature data can be part of the POI data records 207 or can be associated with POIs or POI data records 207 (such as a data point used for displaying or representing a position of a city). In addition, the geographic database 111 can include data from radio advertisements associated with the POI data records 207 and their respective locations in the radio generated POI records 209. By way of example, a street is determined from the user interaction with the UE 101 and the content information associated with UE 101, according to the various embodiments described herein.

The geographic database 111 can be maintained by the content provider in association with the services platform 113 (e.g., a map developer). The map developer can collect geographic data to generate and enhance the geographic database 111. There can be different ways used by the map developer to collect data. These ways can include obtaining data from other sources, such as municipalities or respective geographic authorities. In addition, the map developer can employ field personnel to travel by vehicle along roads throughout the geographic region to observe features and/or record information about them, for example. Also, remote sensing, such as aerial or satellite photography, can be used.

The geographic database 111 can be a master geographic database stored in a format that facilitates updating, maintenance, and development. For example, the master geographic database 111 or data in the master geographic database 111 can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data is compiled (such as into a platform specification format (PSF) format) to organize and/or configure the data for performing navigation-related functions and/or services, such as route calculation, route guidance, map display, speed calculation, distance and travel time functions, and other functions, by a navigation device, such as by a UE 101, for example. The navigation-related functions can correspond to vehicle navigation, pedestrian navigation, or other types of navigation. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases.

As mentioned above, the geographic database 111 can be a master geographic database, but in alternate embodiments, the geographic database 111 can represent a compiled navigation database that can be used in or with end user devices (e.g., UE 101) to provided navigation-related functions. For example, the geographic database 111 can be used with the end user device UE 101 to provide an end user with navigation features. In such a case, the geographic database 111 can be downloaded or stored on the end user device UE 101, such as in applications 103, or the end user device UE 101 can access the geographic database 111 through a wireless or wired connection (such as via a server and/or the communication network 107), for example.

In one embodiment, the end user device or UE 101 can be an in-vehicle navigation system, a personal navigation device (PND), a portable navigation device, a cellular telephone, a mobile phone, a personal digital assistant (PDA), a watch, a camera, a computer, and/or other device that can perform navigation-related functions, such as digital routing and map display. In one embodiment, the navigation device UE 101 can be a cellular telephone. An end user can use the device UE 101 for navigation functions such as guidance and map display, for example, and for determination of traffic information along the one or more travel segments, according to exemplary embodiments.

Figure 3:
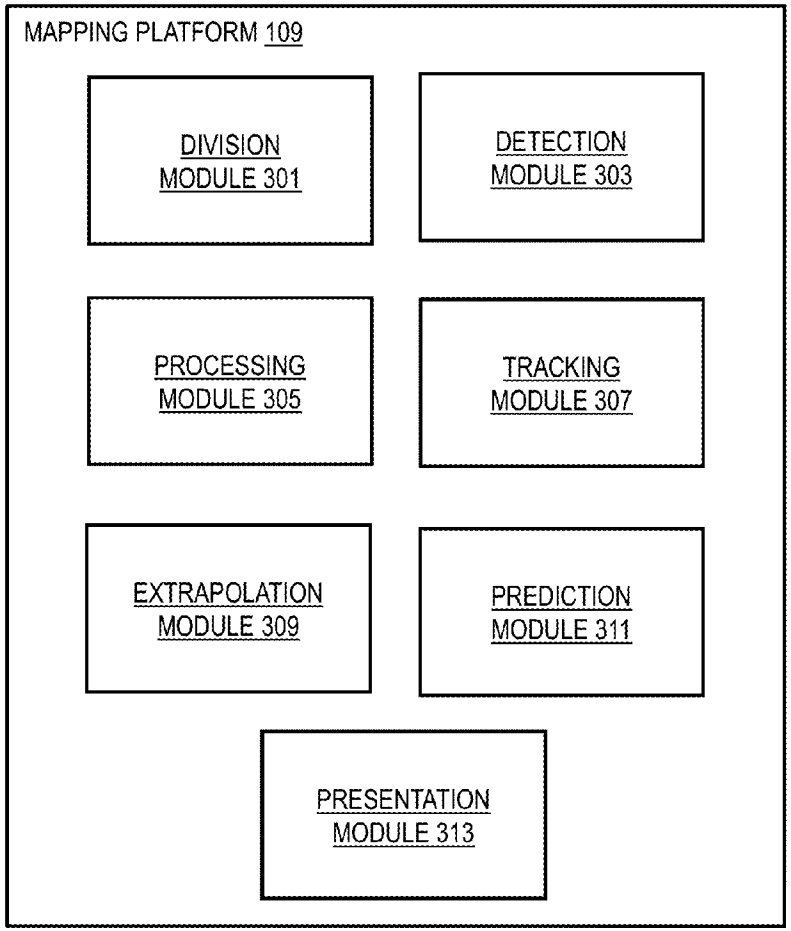
FIG. 3 is a diagram of the components of the mapping platform 109, according to one embodiment.

FIG. 3 is a diagram of the components of the mapping platform 109, according to one embodiment. By way of example, the mapping platform 109 includes one or more components for predicting starting points and/or ending points for traffic jams in one or more travel segments. It is contemplated that the functions of these components may be combined in one or more components or performed by other components of equivalent functionality. In this embodiment, the mapping platform 109 includes a division module 301, a detection module 303, a processing module 305, a tracking module 307, an extrapolation module 309, a prediction module 311, and a presentation module 313.

In one embodiment, the division module 301 may cause a division of distance dimensions for one or more travel segments into one or more even sections. Then, the division module 301 may cause an assignment of speed information to the one or more sections, wherein the speed information is an average of the probe data that falls into the one or more sections. In another embodiment, the division module 301 may plot at least one speed curve based, at least in part, on the probe data, the distance dimensions, or a combination thereof to detect one or more location points where traffic speed is above or below a traffic jam threshold.

In one embodiment, the detection module 303 may detect probe data for one or more travel segments. Then, the detection module 303 may collect the probe data for at least one section of the one or more travel segments in a particular time frame. In another embodiment, the detection module may determine curve data based, at least in part, on velocity information, distance information, or a combination thereof associated with the one or more travel segments. In a further embodiment, the detection module 303 may select at least one adjacent section upon detecting that the at least one section is empty.

In one embodiment, the processing module 305 may process traffic information for the one or more travel segments to determine the traffic jam threshold. The at least one congested section of at least one travel segment has traffic speed lesser than the traffic jam threshold. In another embodiment, the processing module 305 may process the curve data received from the detection module 303 to predict the at least one location point, the at least one time frame, or a combination thereof for future traffic jams. In a further embodiment, the processing module 305 may calculate a moving average along the distance dimension to generate the at least one speed curve. In another embodiment, the processing module 305 may determine that the traffic jam ends at the at least one section when the speed curve is higher than the traffic jam threshold for one or more consecutive sections.

In one embodiment, the tracking module 307 may track the speed curve generated via processing module 305 to determine that the traffic jam starts at the at least one section of the distance dimension when the speed curve falls below the traffic jam threshold. In another embodiment, the tracking module 307 may track the at least one start point and/or at least one end point for a traffic jam.

In one embodiment, the extrapolation module 309 may extrapolate at least one start point and/or at least one end point in the distance dimension, the time dimension, or a combination thereof. Then, the extrapolation module 309 may cause curve plotting to generate a trend curve that represents a trend of the traffic jam, wherein the curve plotting include linear regression, and wherein the trend curve predicts the at least one start point and/or at least one end point for the future traffic jams. In one scenario, the moving of one or more start points and/or end points may capture ripples along the road segment in time. In one alternative, the trend curve may be a curve at the distance-time space that represents how fast these ripples expand or shrink in time.

In one embodiment, the prediction module 311 may predict at least one starting point, at least one ending point, or a combination thereof for traffic jam in the one or more travel segments, wherein the at least one starting point represents at least one location where the traffic jam starts, the at least one ending point represents at least one location where the traffic speed recovers to normal, or a combination thereof. In another embodiment, the prediction module 311 may cause a prediction of the traffic jam based, at least in part, on the at least one start point wherein the at least one start point is generated when there is not a significant distance between a new start point and a predicted start point. In a further embodiment, the prediction module 311 may either cause a dynamic adjusting of the trend curve by re-doing the curve plotting if the distance between the observed start point and the predicted start point is not significant, or invalidate the trend curve if there is a significant distance between a prediction and an observation.

In one embodiment, the presentation module 313 makes a colored presentation of a map with determined routes, points of interest, and/or transition waypoints. The presentation module 313 may utilize the geographic database 111 and/or services 115 to determine whether the information for a route is up to date. This module obtains a set of summary statistics from other modules. Then, the presentation module 313 continues with generating a presentation corresponding to the destination. Subsequently, the presentation module 313 continues with providing a presentation of data set where the presentation could be depicted in one or more visual display units.

The above presented modules and components of the mapping platform 109 can be implemented in hardware, firmware, software, or a combination thereof. Though depicted as a separate entity in FIG. 1, it is contemplated that the mapping platform 109 may be implemented for direct operation by respective UE 101. As such, the mapping platform 109 may generate direct signal inputs by way of the operating system of the UE 101 for interacting with the applications 103. In another embodiment, one or more of the modules 301-313 may be implemented for operation by respective UEs, the mapping platform 109, or combination thereof. Still further, the mapping platform 109 may be integrated for direct operation with services 115, such as in the form of a widget or applet, in accordance with an information and/or subscriber sharing arrangement. The various executions presented herein contemplate any and all arrangements and models.

Figure 4:
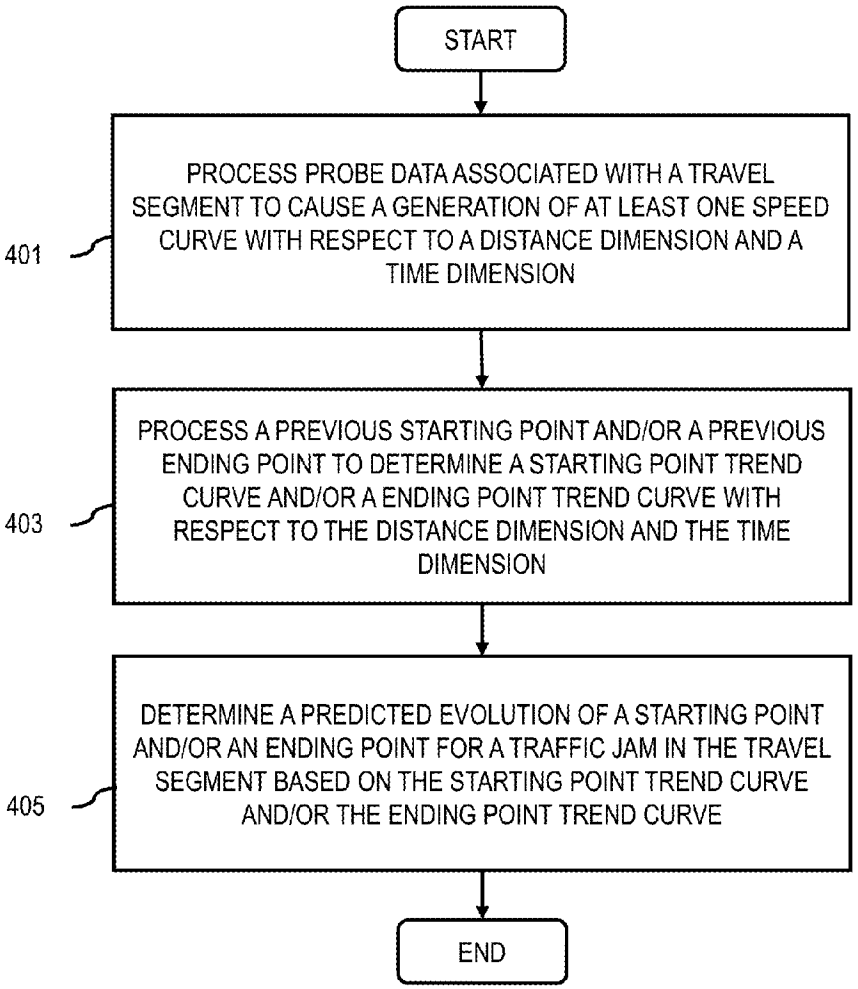
FIG. 4 is a flowchart of a process for predicting location points for traffic jams in travel segments based on trend curves, according to one embodiment.
Figure 17:
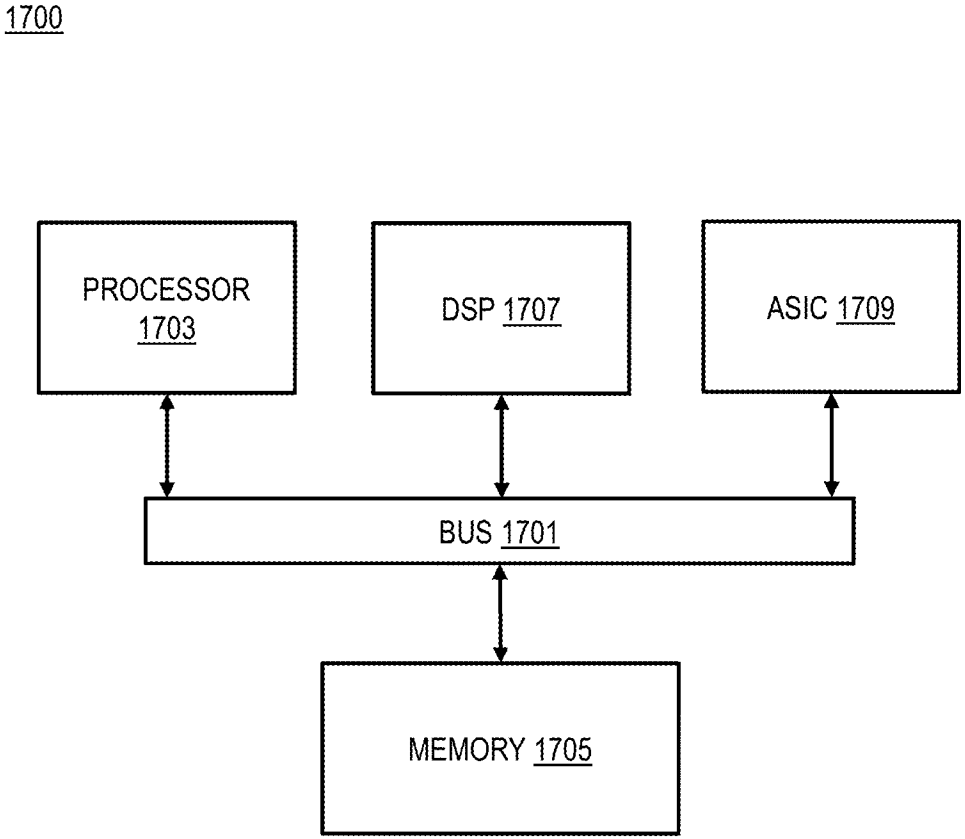
FIG. 17 is a diagram of a chip set that can be used to implement an embodiment of the invention.

FIG. 4 is a flowchart of a process for predicting location points for traffic jams in travel segments based on trend curves, according to one embodiment. In one embodiment, the mapping platform 109 performs the process 400 and is implemented in, for instance, a chip set including a processor and a memory as shown in FIG. 17.

In step 401, the mapping platform 109 may process and/or facilitate a processing of probe data associated with at least one travel segment to cause, at least in part, a generation of at least one speed curve with respect to a distance dimension and a time dimension. In one embodiment, the probe data includes speed information. In one scenario, the probe data includes a set of information pertaining to traffic speed, vehicle movements, or a combination thereof with time-stamped geographic locations (e.g., location data such as GPS data). In one example embodiment, a UE 101 (e.g., UE 101 associated with at least one vehicle, smart vehicles, etc.) may transmit probe data (e.g., speed information, traffic information, etc.) via sensors 105 in real-time, as per schedule, as per request, or a combination. The mapping platform 109 may process the probe data associated with the vehicle to determine speed patterns, traffic progression, travel duration in at least one travel segment, distance information, and/or any relevant traffic information. In another embodiment, the at least one speed curve indicates at least one previous starting point, at least one previous ending point, or a combination thereof for one or more previous traffic jams based, at least in part, on the traffic speed information. In one example embodiment, the mapping platform 109 may divide the distance dimension associated with the at least one road segment into several sections. A time window of certain width may slide along the time dimension during certain time period. The mapping platform 109 may assign each distance section a speed which is the average of all probe points that falls into the section. Then, the probe points that fall into the time window may be used by the mapping platform 109 for traffic jam detection. Subsequently, the mapping platform 109 may perform a moving average along the distance dimension to generate a speed curve.

In step 403, the mapping platform 109 may process and/or facilitate a processing of the at least one previous starting point, the at least one previous ending point, or a combination thereof to determine at least one starting point trend curve, at least one ending point trend curve, or a combination thereof with respect to the distance dimension and the time dimension. In one scenario, a trend curve represents the movement of the traffic in at least one travel segment. In one scenario, the trend curve results from curve fitting the past moving of start points and/or end points. The trend curve is then used to predict the future moving of the start points and/or end points. In one example embodiment, the mapping platform 109 may accumulate one or more previous start points and/or one or more previous end points to generate a trend curve that depicts the movement of traffic jam in at least one travel segment. In one scenario, the mapping platform 109 may determine traffic jam in at least one travel segment when the speed information for one or more vehicles in the travel segment falls below the predetermined speed threshold. In another scenario, the mapping platform 109 may determine traffic jam upon detecting at least one obstruction (e.g., an accident) that is impeding the progression of other vehicles in at least one travel segment.

In step 405, the mapping platform 109 may determine at least one predicted evolution or change of at least one starting point, at least one ending point, or a combination thereof for at least one traffic jam in the at least one travel segment based, at least in part, on the at least one starting point trend curve, the at least one ending point trend curve, or a combination thereof. In one scenario, the mapping platform 109 may accurately track the evolution or change of traffic jams based, at least in part, on the probe data provided by connected driving. Then, the mapping platform 109 may determine a start location (i.e., location point where the traffic jam starts) and end location (i.e., location points where the traffic starts to recover to normal speed). In one scenario, the mapping platform 109 may observe the one or more traffic trend curves to cause a prediction of the traffic jam in at least one location point of the at least one travel segment.

Figure 5:
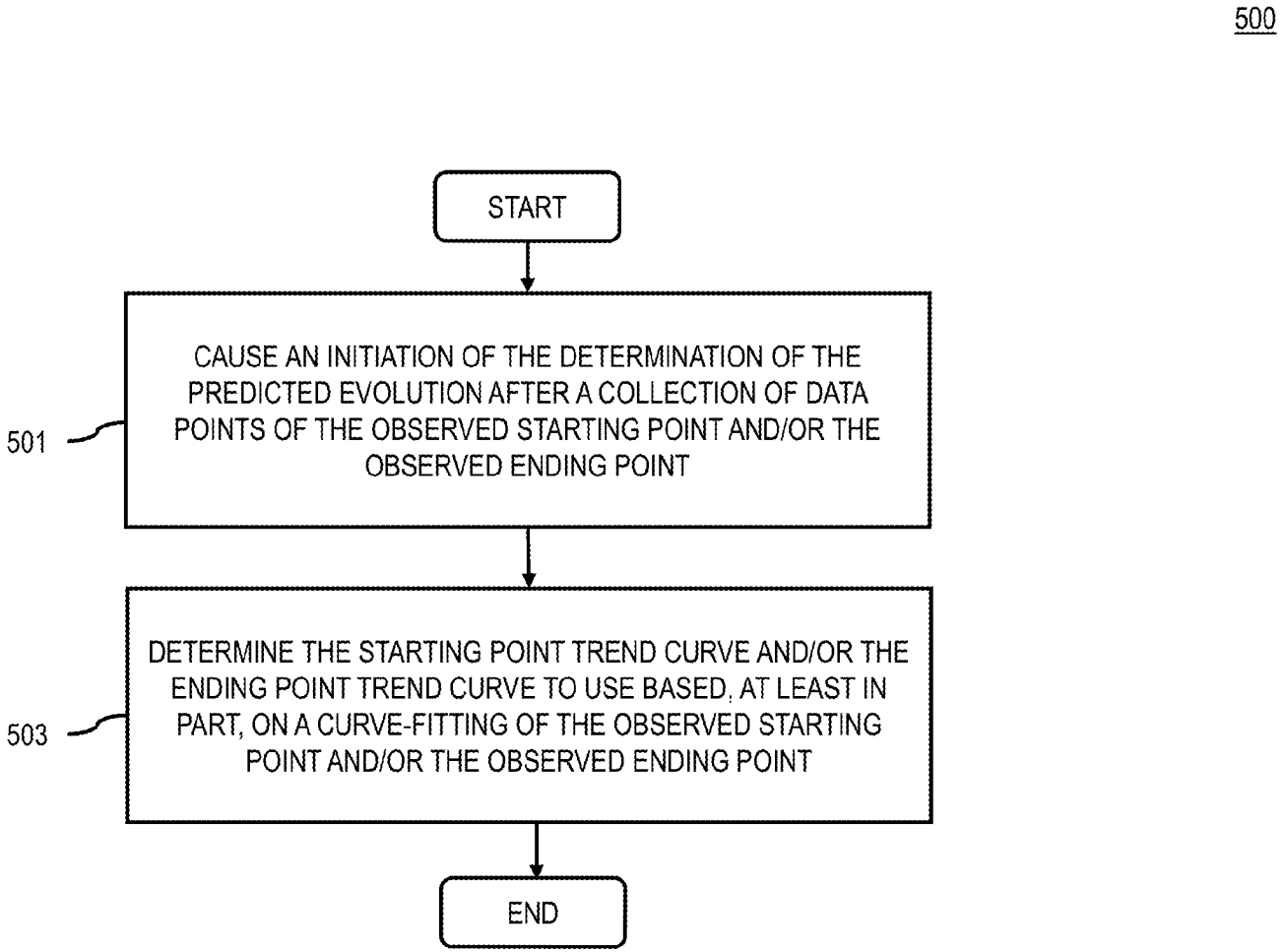
FIG. 5 is a flowchart of a process for collecting data points of observed starting point and/or ending point to predict traffic evolution or change and cause a curve fitting, according to one embodiment.

FIG. 5 is a flowchart of a process for collecting data points of observed starting point and/or ending point to predict traffic evolution or change and cause a curve fitting, according to one embodiment. In one embodiment, the mapping platform 109 performs the process 500 and is implemented in, for instance, a chip set including a processor and a memory as shown in FIG. 17.

In step 501, the mapping platform 109 may cause, at least in part, an initiation of the determination of the at least one predicted evolution or change after a collection of one or more data points of the at least one observed starting point, the at least one observed ending point, or a combination thereof. In one scenario, the mapping platform 109 may track start points for traffic jams in at least one travel segment during a particular time period. These tracked start points are collected, and is utilized in predicting how the start points would evolve in the near future.

In step 503, the mapping platform 109 may determine the at least one starting point trend curve, the at least one ending point trend curve, or a combination thereof to use based, at least in part, on a curve-fitting of the at least one observed starting point, the at least one observed ending point, or a combination thereof. In one scenario, the mapping platform 109 may observe one or more start points and/or one or more end points for traffic jams in at least one travel segment. Then, the mapping platform 109 may initiate a curve fitting to generate a curve which represents the trend of the traffic jam. The trend curve predicts the future movement of the traffic jam start point.

Figure 6:
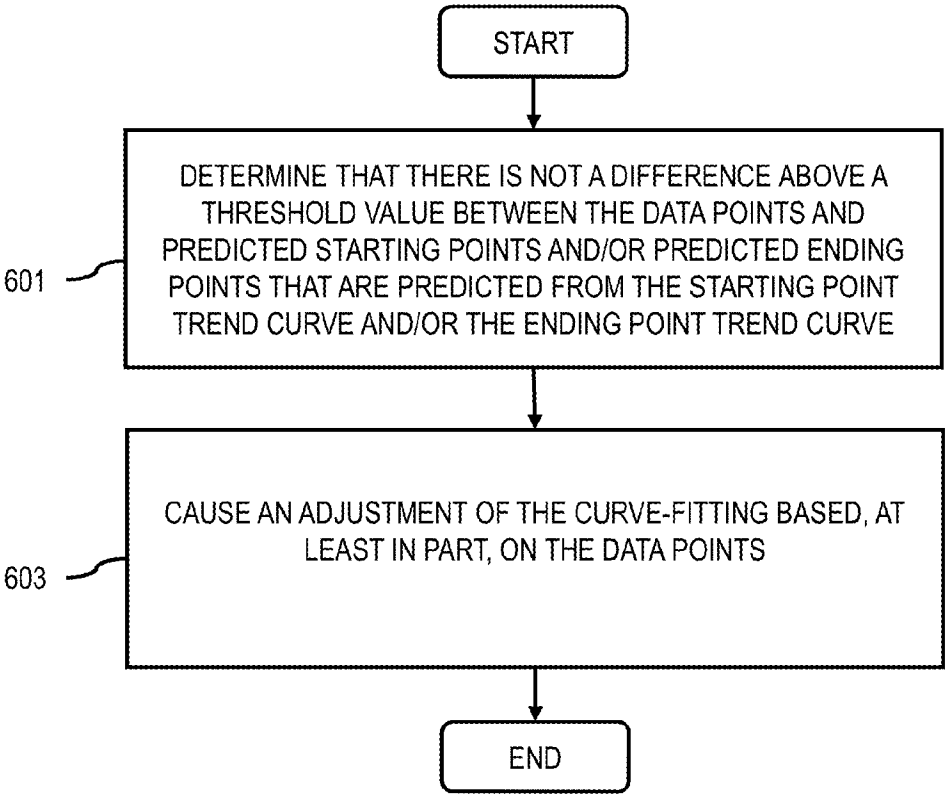
FIG. 6 is a flowchart of a process for causing an adjustment of the curve-fitting based on difference between observed data points and predicted data points, according to one embodiment.

FIG. 6 is a flowchart of a process for causing an adjustment of the curve-fitting based on difference between observed data points and predicted data points, according to one embodiment. In one embodiment, the mapping platform 109 performs the process 600 and is implemented in, for instance, a chip set including a processor and a memory as shown in FIG. 17.

In step 601, the mapping platform 109 may determine that there is not a difference above a threshold value between the one or more data points and one or more predicted starting points, one or more predicted ending points, or a combination thereof that are predicted from the at least starting point trend curve, the at least one ending point trend curve, or a combination thereof. In one scenario, the prediction procedure stops when the difference between an observation point and a predicted point is above a threshold value. A difference above the threshold value indicates that the traffic jam has started to recover.

In step 603, the mapping platform 109 may cause, at least in part, an adjustment of the curve-fitting based, at least in part, on the one or more data points. In one scenario, the mapping platform 109 may conduct curve fitting to generate a curve which represents the trend of a traffic jam. The trend curve predicts the future movement of a traffic jam. Then, the mapping platform 109 may dynamically adjust the trend curve by re-doing curve fitting with the existing start points including the new one if the difference between an observation point and a predicted point is below the threshold value.

Figure 7:
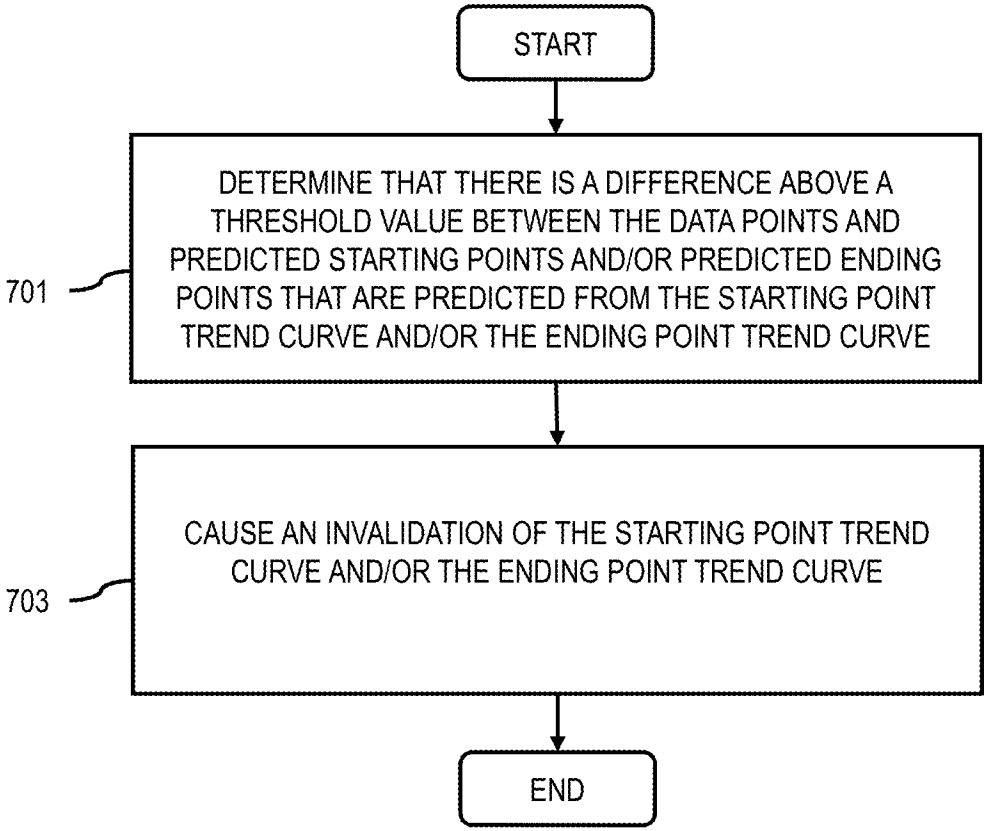
FIG. 7 is a flowchart of a process for causing an invalidation of one or more trend curves based on difference between observed data points and predicted data points, according to one embodiment.

FIG. 7 is a flowchart of a process for causing an invalidation of one or more trend curves based on difference between observed data points and predicted data points, according to one embodiment. In one embodiment, the mapping platform 109 performs the process 700 and is implemented in, for instance, a chip set including a processor and a memory as shown in FIG. 17.

In step 701, the mapping platform 109 may determine that there is a difference above a threshold value between the one or more data points and one or more predicted starting points, one or more predicted ending points, or a combination thereof that are predicted from the at least starting point trend curve, the at least one ending point trend curve, or a combination thereof.

In step 703, the mapping platform 109 may cause, at least in part, an invalidation of the at least one starting point trend curve, the at least one ending point trend curve, or a combination thereof. In one scenario, the mapping platform 109 may stop the prediction process and may invalidate the existing trend curve upon determination of significant distance (i.e., difference above a threshold value) between the observation points and the prediction points. The significant distance between the prediction points and the observation points indicates that the start point is moving at an opposite direction than the predicted trend line.

Figure 8:
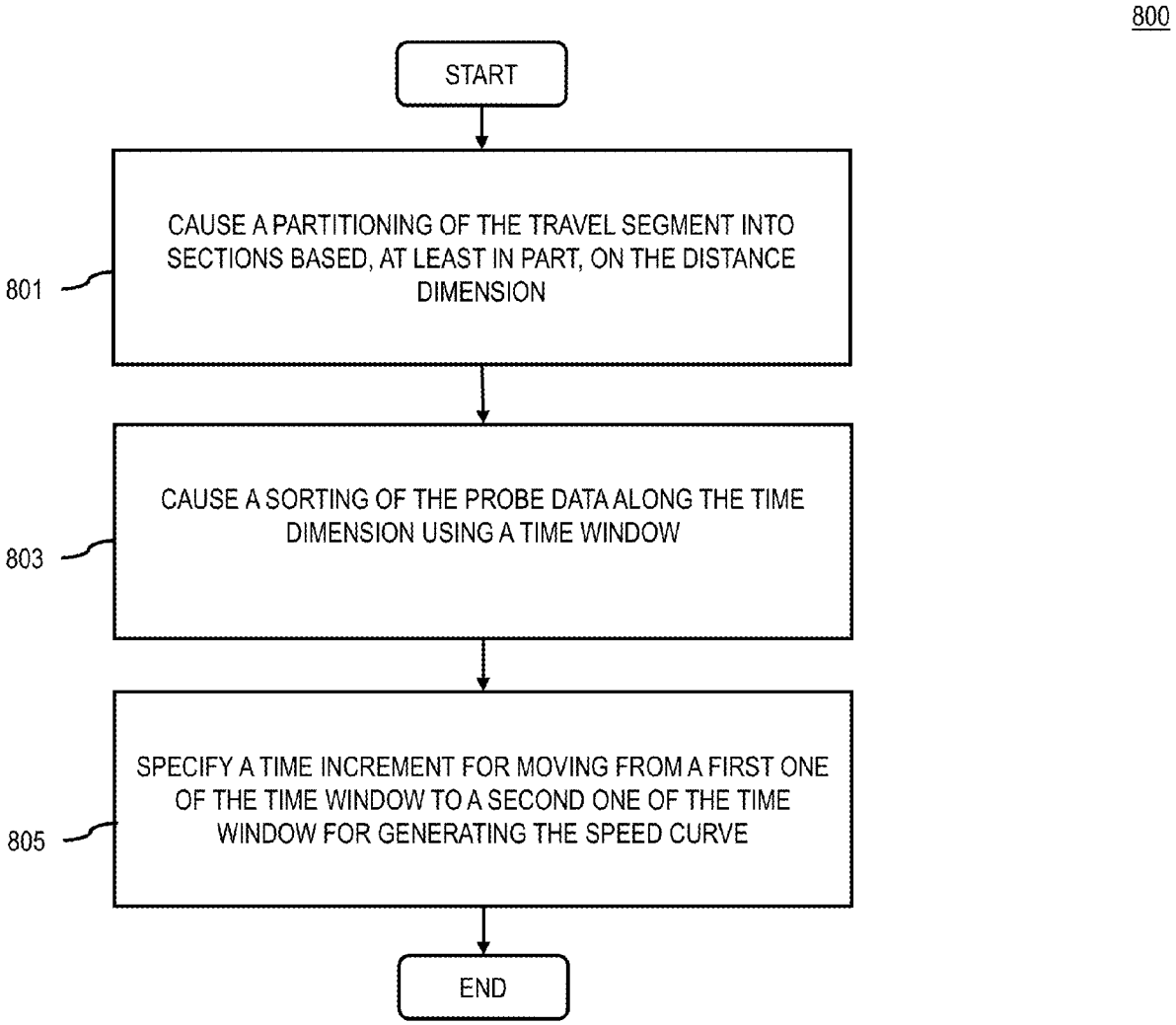
FIG. 8 is a flowchart of a process for partitioning travel segments based on distance dimension, and sorting probe data along the time dimension, according to one embodiment.

FIG. 8 is a flowchart of a process for partitioning travel segments based on distance dimension, and sorting probe data along the time dimension, according to one embodiment. In one embodiment, the mapping platform 109 performs the process 800 and is implemented in, for instance, a chip set including a processor and a memory as shown in FIG. 17.

In step 801, the mapping platform 109 may cause, at least in part, a partitioning of at least one travel segment into one or more sections based, at least in part, on a distance dimension. In one scenario, the mapping platform 109 may assign speed for each section. The assigned speed is the average of probe points falling with the section. The generation of the at least one speed curve is based, at least in part, on the one or more sections.

In step 803, the mapping platform 109 may cause, at least in part, a sorting of the probe data along the time dimension using at least one time window. The at least one time window is associated respectively with the at least one speed curve. In one scenario, a time window may slide along the time axis during certain time period, and the probe points that fall into the time window are used for traffic jam detection.

In step 805, the mapping platform 109 may specify at least one time increment for moving from a first one of the at least one time window to a second one of the time window for generating the at least one speed curve. In one scenario, a time window of certain width may slide along the time axis with a certain increment (e.g., 5 minutes) and constructs a speed curve that represents the changes in traffic speed over the distance.

Figure 9:
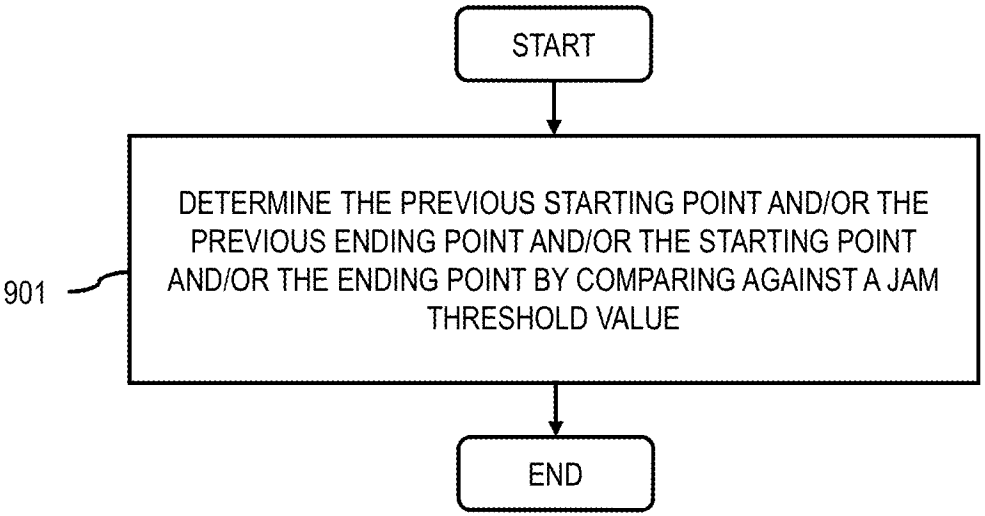
FIG. 9 is a flowchart of a process for comparing one or more starting points and/or one or more ending points against at least one jam threshold, according to one embodiment.

FIG. 9 is a flowchart of a process for comparing one or more starting points and/or one or more ending points against at least one jam threshold, according to one embodiment. In one embodiment, the mapping platform 109 performs the process 900 and is implemented in, for instance, a chip set including a processor and a memory as shown in FIG. 17.

In step 901, the mapping platform 109 may determine the at least one previous starting point, the at least one previous ending point, the at least one starting point, the at least one ending point, or a combination thereof by comparing against at least one jam threshold value. In one embodiment, the determining of the at least one previous starting point, the at least one previous ending point, the at least one starting point, the at least one ending point, or a combination thereof is further based, at least in part, on at least one noise tolerance value. In another embodiment, the at least one noise tolerance represents a threshold number of consecutive observations to make before the determining of the at least one previous starting point, the at least one previous ending point, the at least one starting point, the at least one ending point, or a combination thereof is made. In one embodiment, the traffic jam threshold with regards to starting point for a traffic jam and/or the ending point for a traffic jam can be based, at least in part, on the function of the speed limit of at least one road segment, the speed category, the road types, or a combination thereof. In one scenario, the road types may include high function roads (i.e., roads with high speed threshold), low function roads (i.e., roads with low speed threshold), or a combination thereof. The high function roads may include interstate highways, state highways, and any major roads. Whereas low function roads may include access roads, local streets, etc. In another scenario, the mapping platform 109 may determine average speed information for at least one road segment. Then, the mapping platform 109 may determine speed information of one or more vehicles travelling in the road segment to determine any indication of traffic jams.

Figure 10:
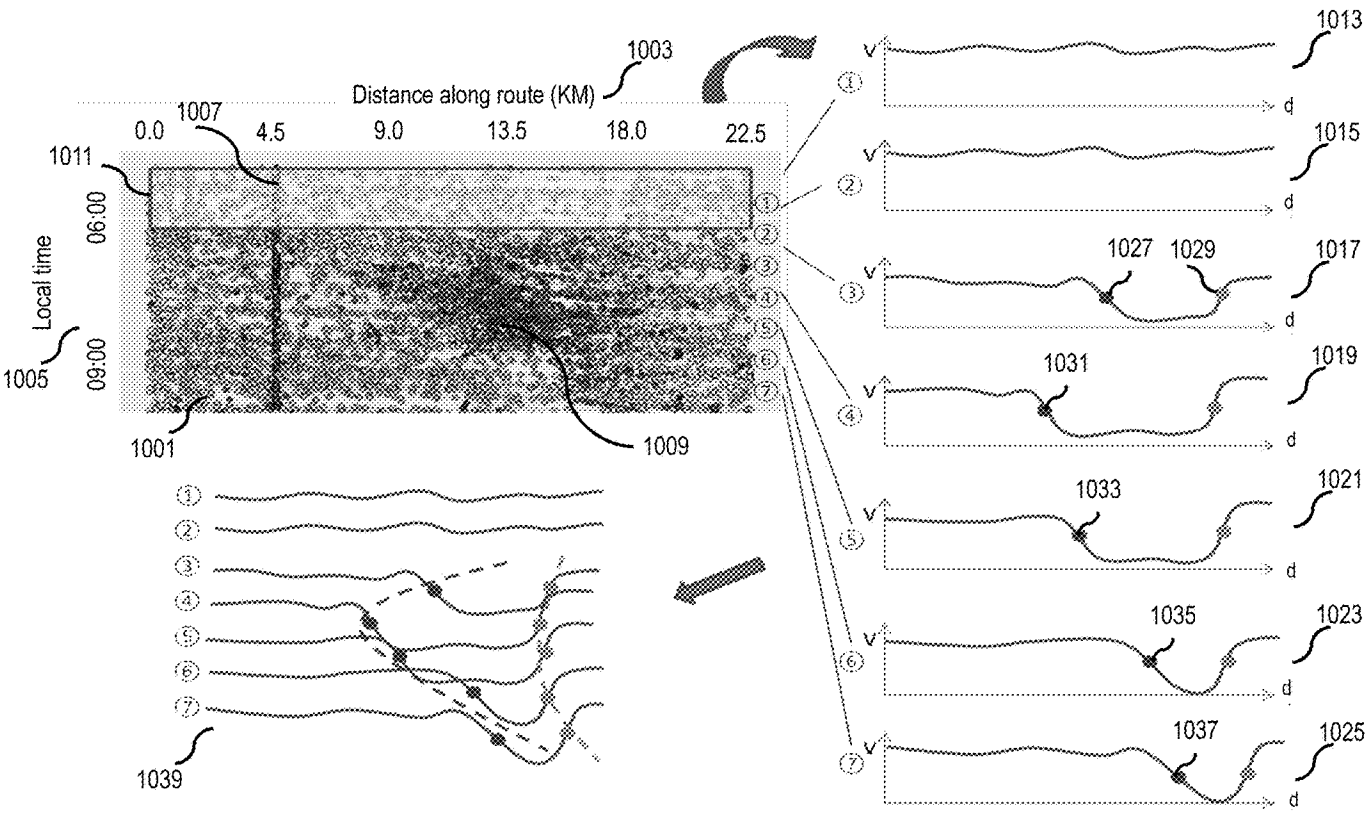
FIG. 10 is a diagram that represents a scenario wherein starting points and/or ending points for traffic jams are detected in travel segments, according to one example embodiment.

FIG. 10 is a diagram that represents a scenario wherein starting points and/or ending points for traffic jams are detected in travel segments, according to one example embodiment. The density and/or speed of the vehicles passing through travel segments may determine the traffic situation. In one scenario, the points 1001 represent probe points (i.e., location points associated with the speed of vehicles travelling on the highway). The speed of vehicles may be represented in various manners, for example, darker probe points denote vehicles with slower speed whilst lighter probe points denote vehicles with higher speed. In one scenario, the X-axis 1003 represents the distance along the at least one highway (e.g., the length of 22.5 kilometers) whereas the Y-axis 1005 represents the time. The distance dimension is evenly partitioned into m sections. The X-axis and the Y-axis represents the speed of vehicles at a particular distance in a specific time. In one example embodiment, traffic jam may occur at any location point in a highway segment (e.g., middle of the highway). Initially, there is no traffic jam (e.g., up till 6 a.m. there is no traffic jam because most of the probe points are lighter). The vertical straight line 1007 at the distance of approximately 4.5 kilometers represents a tunnel, and since there is no signal, probe data could not be collected. Then, after 6 a.m. the traffic jam escalates as more vehicles starts to queue or slow down. The shaded area 1009 represents the progression of a traffic jam. Basically, the traffic jam evolution or change is captured in real-time. In one scenario, the sliding window (e.g., a rectangular box 1011) evaluates the probe points when it slides and constructs the speed curve that represents the changes in traffic speed over the distance. A time window of width T slides along the time axis with the increment equal to $\delta$. Each time after the time window slides, the probe points that fall into the time window are used for traffic jam detection. In one scenario, the sliding window is divided into numerous small pieces depending on the location to compute a moving average. Then, different curves (e.g., 1013, 1015, 1017, 1019, 1021, 1023, and 1025) representing the traffic speed variations over a highway segment of 22.5 kilometers during a series of time windows are generated. In one scenario, curves 1013 and 1015 are stable and there is no abrupt change or a drop in the speed. However, in curve 1017 there is a sudden drop in speed as represented by point 1027, this drop may be bigger than some threshold (e.g., if the speed drops to 5 mph due to a traffic jam). Specifically, each distance section is assigned a speed which is the average of all probe points falling into the section, and if a section is empty, the speed of the adjacent upstream section is taken. Then, moving average is performed along the distance dimension to generate a smoothed speed curve. The point 1027 may represent the starting point of the traffic jam in a road segment whilst the point 1029 may represent the ending point for a traffic jam in a road segment. The mapping platform 109 tracks the change of speed curve. When a speed curve drops below the jam threshold, the algorithm outputs that a jam starts at the current section. In another time window, in curve 1019 the start point 1031 propagates back indicating an increasing trend in the traffic jam. In another time window, at curves 1021, 1023 and 1025, the start points 1033, 1035, and 1037 starts to retrieve as the traffic gains momentum. When the speed curve becomes higher than the jam speed for n consecutive cells, the algorithm outputs that the jam ends at the n-th section. Then, n is a parameter to tolerate noise pikes. Subsequently, these curves are assembled 1039 to clearly show the movement of traffic jam in a certain time period in a road segment, and also to generate a trend curve.

Figure 11:
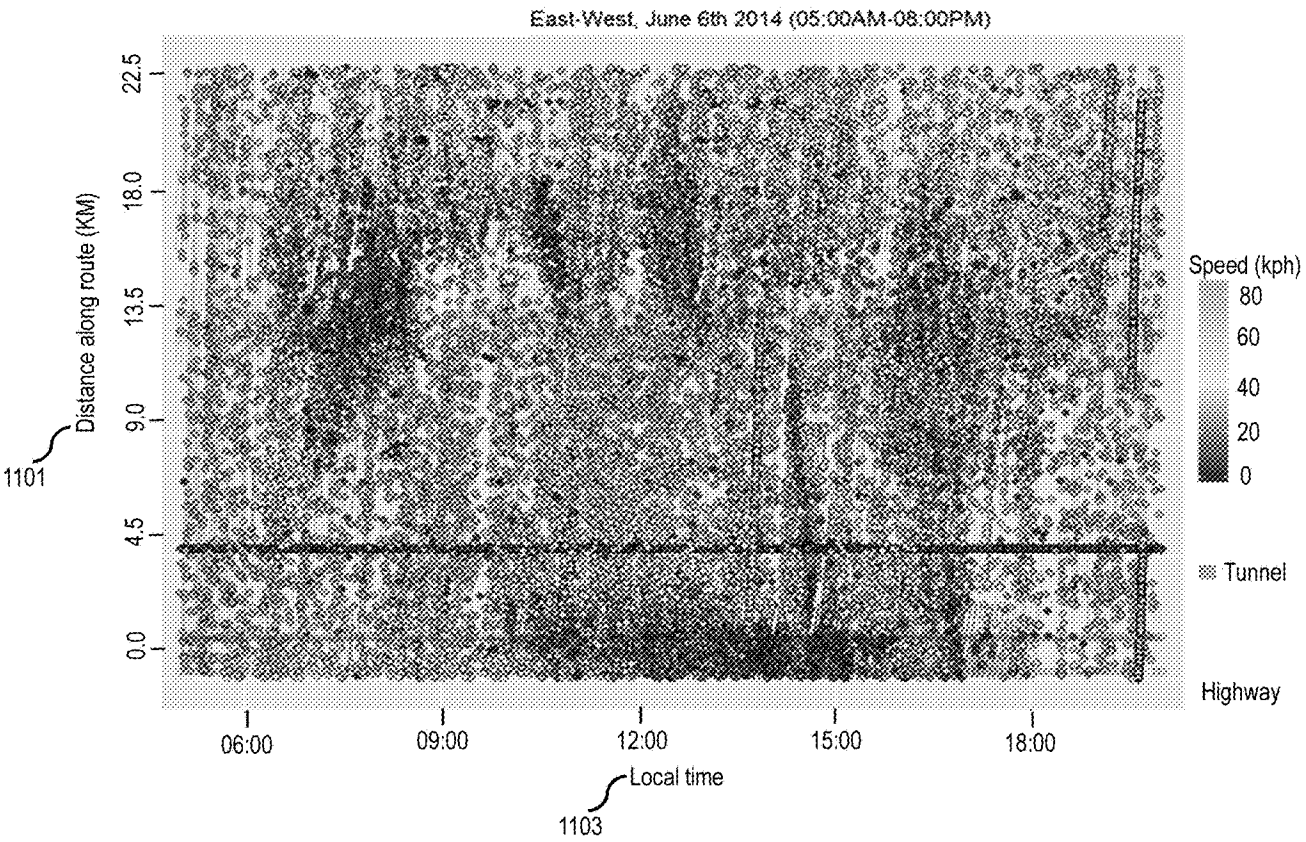
FIG. 11 is a diagram that represents a scenario wherein probe data are used to detect traffic jams, according to one example embodiment.

FIG. 11 is a diagram that represents a scenario wherein probe data are used to detect traffic jams, according to one example embodiment. The probe data used in analyzing the traffic jams are provided by connected driving. In one scenario, the mapping platform 109 may cause a plotting of speed curves based, at least in part, on certain thresholds. For example, the distance section length m may be set to 500 meters, the time window width T may be set to 15 minutes, the sliding increment δ may be set to 5 minutes, the noise tolerance n may be set to 4, and the jam threshold may be set to 25 kilometer per hour (kph). In another scenario, the mapping platform 109 may cause a color representation of at least one highway segment 1101 based, at least in part, on speed information associated with one or more vehicles during various time frame 1103. The darker probe points represent vehicles with slower speed whilst lighter probe points represent vehicles with higher speed.

Figure 12:
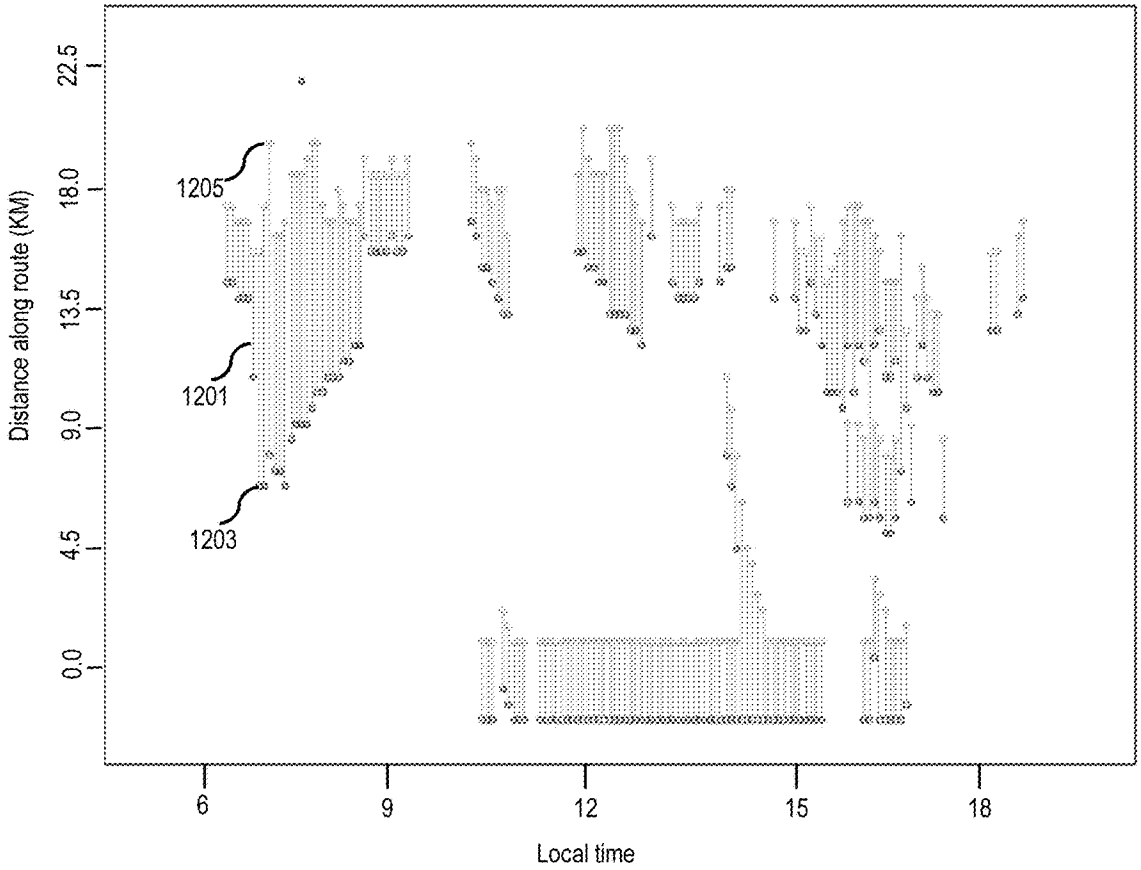
FIG. 12 is a diagram that represents a scenario wherein the one or more vertical line segments 1201 represent a jammed road segment, according to one example embodiment.

FIG. 12 is a diagram that represents a scenario wherein the one or more vertical line segments 1201 represent a jammed road segment, according to one example embodiment. In one example embodiment, the mapping platform 109 may set a jam threshold of 25 kph. Then, speed information for one or more vehicles in the at least one road segment may be tracked. The mapping platform 109 may determine at least one starting point 1203 for a traffic jam when speed for at least one vehicle falls below the jam threshold of 25 kph. Subsequently, the mapping platform 109 may determine at least one ending point 1205 for a traffic jam when vehicular speed progresses above or equal to the jam threshold of 25 kph.

Figure 13:
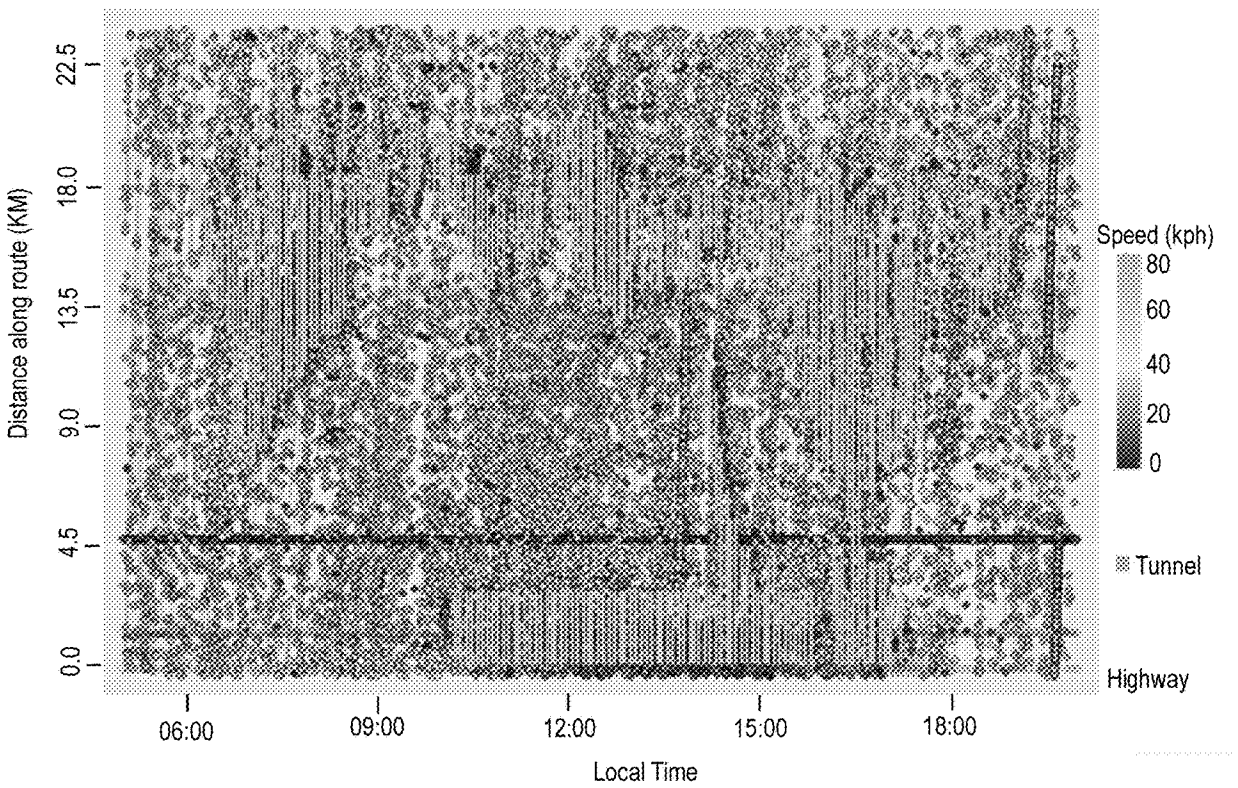
FIG. 13 is a diagram that represents a scenario wherein the result of traffic jam detection is overlaid on the original probe data, according to one example embodiment.

FIG. 13 is a diagram that represents a scenario wherein the result of traffic jam detection is overlaid on the original probe data, according to one example embodiment. In one scenario, the mapping platform 109 may accurately track the formation and the evolution or change of traffic jam. Then, the mapping platform 109 may overlay the result on the original probe data.

Figure 14:
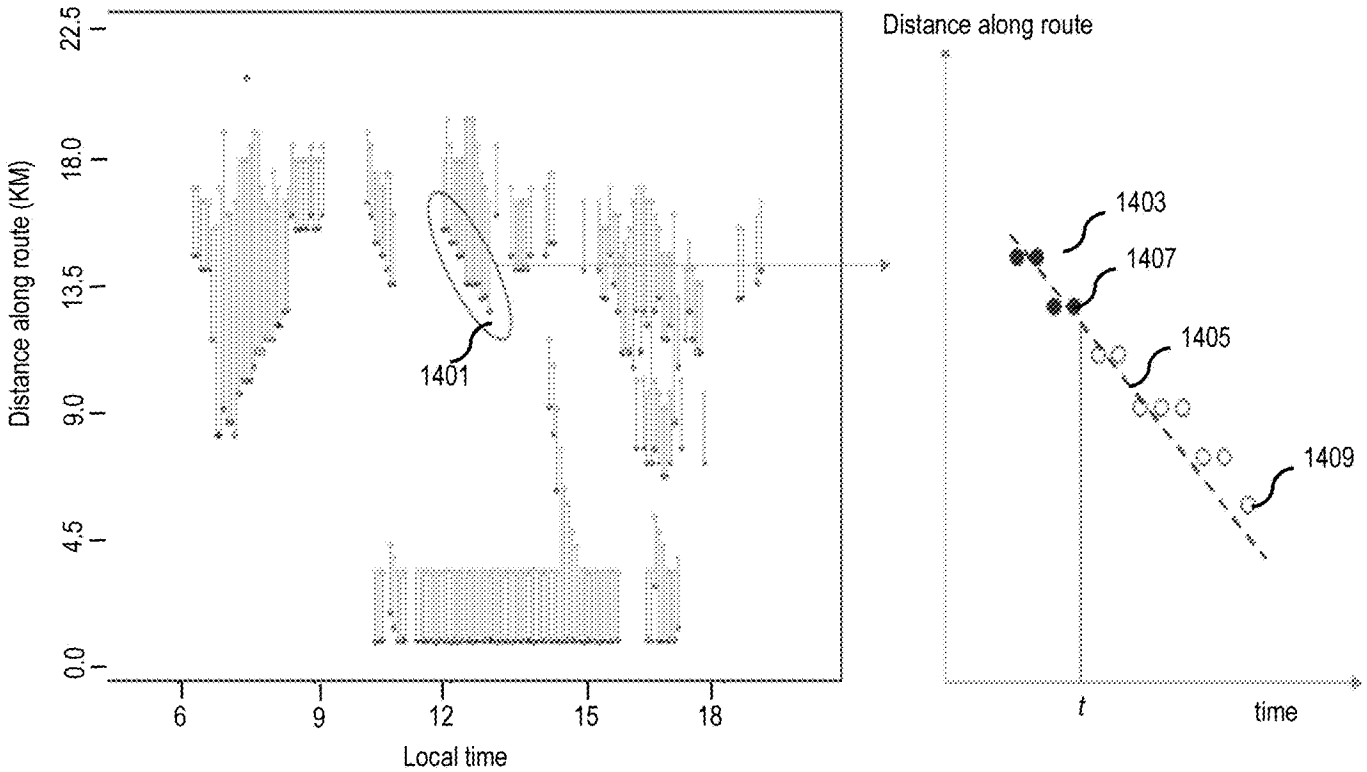
FIG. 14 is a diagram that represents a scenario wherein traffic jams are predicted via a process of extrapolation, according to one example embodiment.

FIG. 14 is a diagram that represents a scenario wherein traffic jams are predicted via a process of extrapolation, according to one example embodiment. In one scenario, the mapping platform 109 may use the historic probe data to understand the speed information for at least one road segment over various time periods. Then, a curve may be modeled based, at least in part, on the historic probe data. Accordingly, when a user navigates towards the road segment, the mapping platform 109 may extrapolate data from the curve model to predict traffic information. In one example embodiment, the mapping platform 109 may track the start point of a traffic jam. Then, the mapping platform 109 may utilize the collected start points to predict evolvement of the start points in the near future. The mapping platform 109 may extrapolate the existing start point curves in the time-distance space. As represented in FIG. 14 the traffic jam marked by an ellipse 1401 may be predicted via the extrapolation process shown in 1403. The prediction procedure initiates after the mapping platform 109 have observed few start points. The mapping platform 109 may conduct curve fitting (e.g., linear regression) to generate a curve which represents the trend of the traffic jam. In one scenario, the dashed red line 1405 represents the trend of the traffic jam, wherein shaded points 1407 are the observed start points, and the empty points 1409 are the future start points to be observed. The trend curve predicts the start point for future movement of the traffic jam after time t. Then, a new observation of start point is generated at time t' (t'>t), if there is not a significant distance between the new start point and the start point predicted for time t', the mapping platform 109 may dynamically adjusts the trend curve by re-doing curve fitting with the existing start points including the new one. On the other hand, if there is a significant distance between the prediction and the observation, the mapping platform 109 may stop the prediction procedure; and the existing trend curve may also be invalidated. A significant distance between the prediction and the observation indicates that the start point is moving at an opposite direction than the predicted trend line. In similar manner the method predicts the movement of the end point of a detected traffic jam.

Figure 15A:
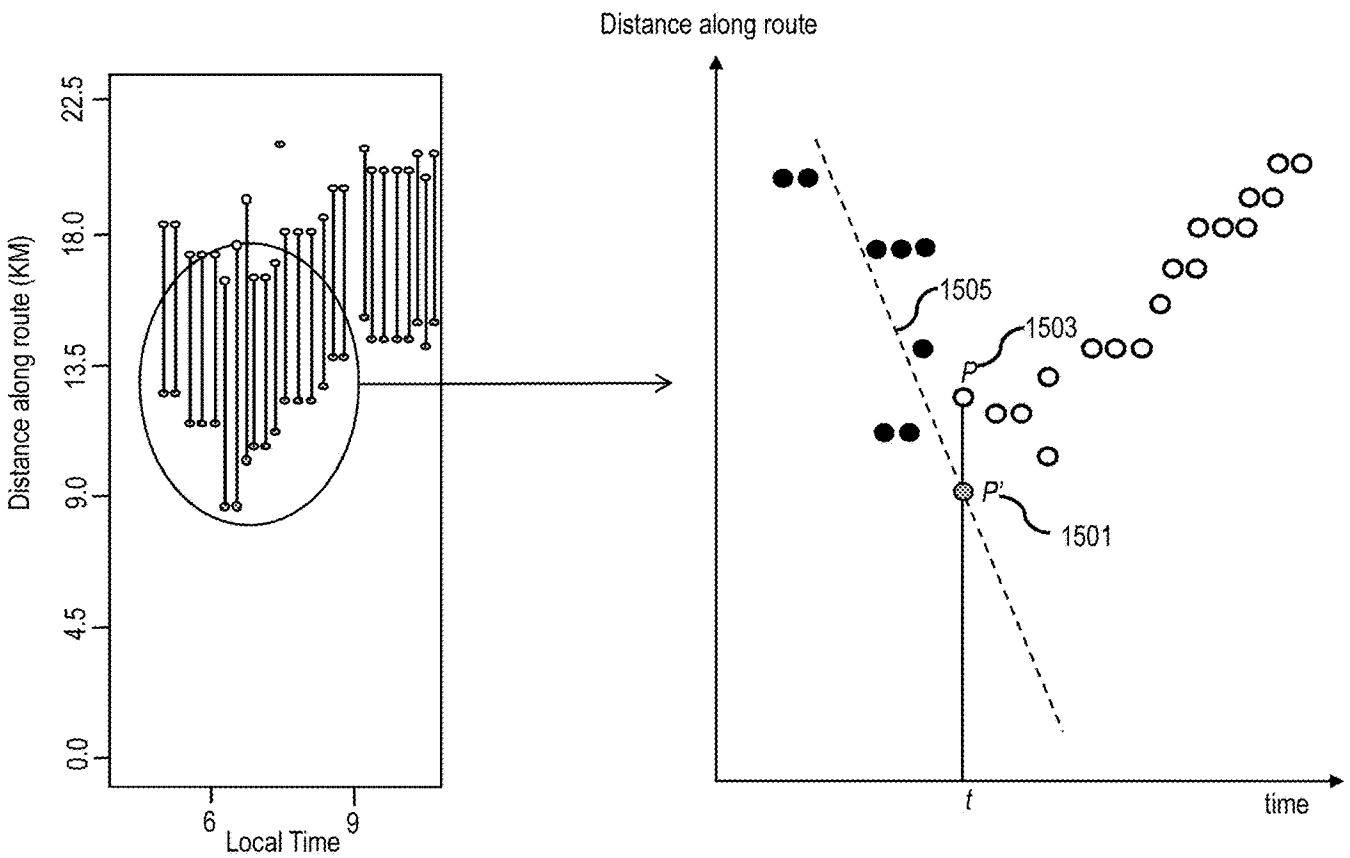
FIG. 15A is a diagram that represents a scenario wherein the predicted values (e.g., locations) are compared with the observed values, according to one example embodiment.

FIG. 15A is a diagram that represents a scenario wherein the predicted values (e.g., locations) are compared with the observed values, according to one example embodiment. In one embodiment, the mapping platform 109 may predict a start point for traffic jam during certain time interval (e.g., after 5 minutes) to be at point p' 1501. Then again, the mapping platform 109 may determine that the start point should have been point P 1503 and not point P' 1501 based, at least in part, on the probe data received after the time interval (i.e., 5 minutes). In one scenario, the prediction procedure stops when there is a significant difference between an observation (point p 1503) and a prediction (point p' 1501). In one scenario, the dashed red line 1505 is the trend curve produced out of previous observations. As discussed, the significant difference indicates that the traffic jam starts to recover. In FIG. 15 since P is behind P' there is a need for an adjustment of the prediction. The mapping platform 109 may observe that the traffic jam is starting to retreat. Then, the mapping platform 109 may apply the retreat pattern by comparing the prediction and the observation. If the prediction is not in-line with the actual observation then it needs to be adjusted for the purpose of extrapolation to create a more accurate prediction.

Figure 15B:
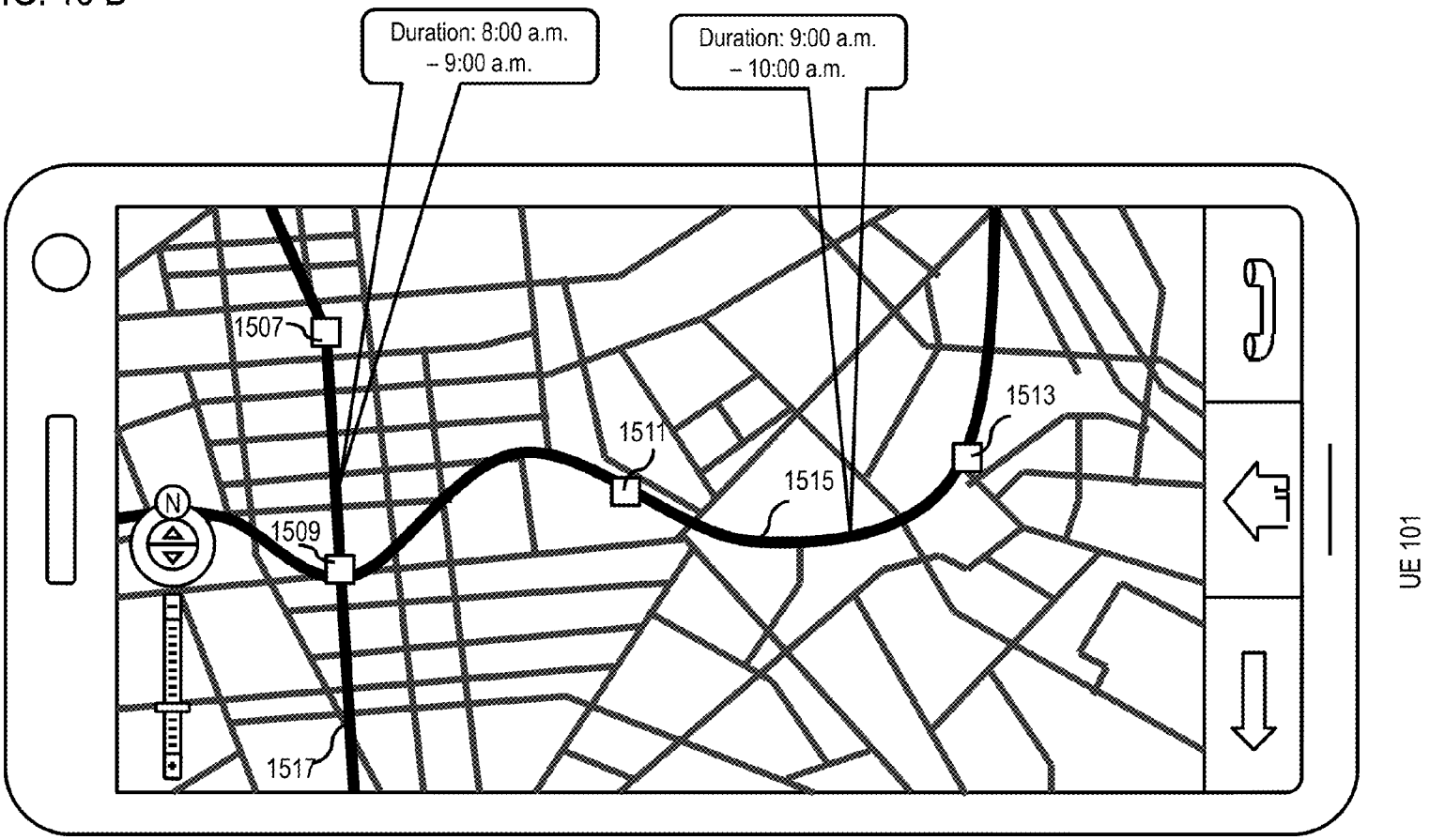
FIG. 15B is a user interface diagram that represents a scenario wherein at least one user is notified on predicted start points and/or predicted end points for traffic jams in one or more travel segments, according to one example embodiment.

FIG. 15B is a user interface diagram that represents a scenario wherein at least one user is notified on predicted start points and/or predicted end points for traffic jams in one or more travel segments, according to one example embodiment. In one scenario, the mapping platform 109 may cause a presentation wherein road segments with predicted traffic jams (i.e., 1515 and 1517) are highlighted. The highlighted road segments may further include predicted starting points (1507, 1511) and/or predicted end points (1509, 1513) for traffic jams. Further, the user may be further provided with duration information on traffic jams so that the user can plan his/her travel accordingly.

The processes described herein for predicting starting points and/or ending points for traffic jams in one or more travel segments may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

Figure 16:
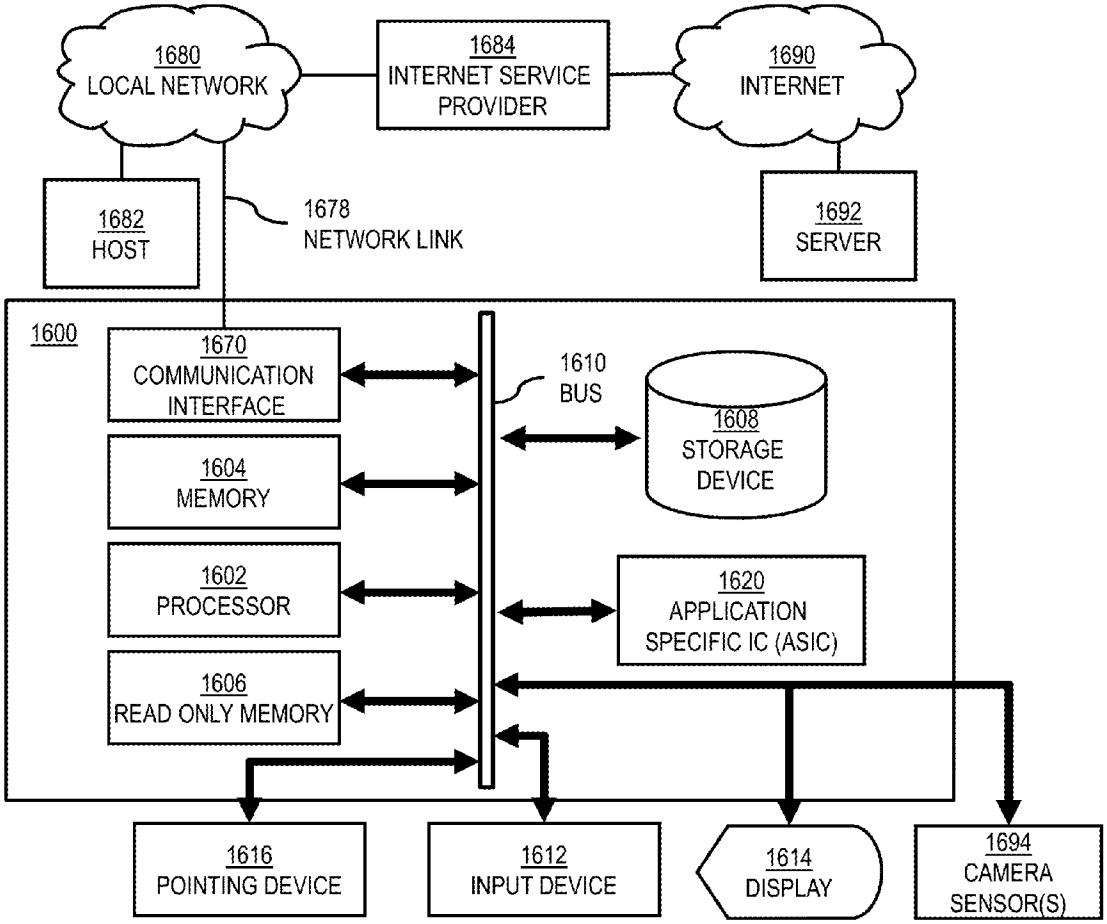
FIG. 16 is a diagram of hardware that can be used to implement an embodiment of the invention.

FIG. 16 illustrates a computer system 1600 upon which an embodiment of the invention may be implemented. Although computer system 1600 is depicted with respect to a particular device or equipment, it is contemplated that other devices or equipment (e.g., network elements, servers, etc.) within FIG. 16 can deploy the illustrated hardware and components of system 1600. Computer system 1600 is programmed (e.g., via computer program code or instructions) to predict starting points and/or ending points for traffic jams in one or more travel segments as described herein and includes a communication mechanism such as a bus 1610 for passing information between other internal and external components of the computer system 1600. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range. Computer system 1600, or a portion thereof, constitutes a means for performing one or more steps of predicting starting points and/or ending points for traffic jams in one or more travel segments.

A bus 1610 includes one or more parallel conductors of information so that information is transferred quickly among devices coupled to the bus 1610. One or more processors 1602 for processing information are coupled with the bus 1610.

A processor (or multiple processors) 1602 performs a set of operations on information as specified by computer program code related to predict starting points and/or ending points for traffic jams in one or more travel segments. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 1610 and placing information on the bus 1610. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 1602, such as a sequence of operation codes, constitute processor instructions, also called computer system instructions or, simply, computer instructions. Processors may be implemented as mechanical, electrical, magnetic, optical, chemical, or quantum components, among others, alone or in combination.

Computer system 1600 also includes a memory 1604 coupled to bus 1610. The memory 1604, such as a random access memory (RAM) or any other dynamic storage device, stores information including processor instructions for predicting starting points and/or ending points for traffic jams in one or more travel segments. Dynamic memory allows information stored therein to be changed by the computer system 1600. RAM allows a unit of information stored at a location called a memory address to be stored and retrieved independently of information at neighboring addresses. The memory 1604 is also used by the processor 1602 to store temporary values during execution of processor instructions. The computer system 1600 also includes a read only memory (ROM) 1606 or any other static storage device coupled to the bus 1610 for storing static information, including instructions, that is not changed by the computer system 1600. Some memory is composed of volatile storage that loses the information stored thereon when power is lost. Also coupled to bus 1610 is a non-volatile (persistent) storage device 1608, such as a magnetic disk, optical disk or flash card, for storing information, including instructions, that persists even when the computer system 1600 is turned off or otherwise loses power.

Information, including instructions for predicting starting points and/or ending points for traffic jams in one or more travel segments, is provided to the bus 1610 for use by the processor from an external input device 1612, such as a keyboard containing alphanumeric keys operated by a human user, a microphone, an Infrared (IR) remote control, a joystick, a game pad, a stylus pen, a touch screen, or a sensor. A sensor detects conditions in its vicinity and transforms those detections into physical expression compatible with the measurable phenomenon used to represent information in computer system 1600. Other external devices coupled to bus 1610, used primarily for interacting with humans, include a display device 1614, such as a cathode ray tube (CRT), a liquid crystal display (LCD), a light emitting diode (LED) display, an organic LED (OLED) display, a plasma screen, or a printer for presenting text or images, and a pointing device 1616, such as a mouse, a trackball, cursor direction keys, or a motion sensor, for controlling a position of a small cursor image presented on the display 1614 and issuing commands associated with graphical elements presented on the display 1614, and one or more camera sensors 1694 for capturing, recording and causing to store one or more still and/or moving images (e.g., videos, movies, etc.) which also may comprise audio recordings. In some embodiments, for example, in embodiments in which the computer system 1600 performs all functions automatically without human input, one or more of external input device 1612, display device 1614 and pointing device 1616 may be omitted.

In the illustrated embodiment, special purpose hardware, such as an application specific integrated circuit (ASIC) 1620, is coupled to bus 1610. The special purpose hardware is configured to perform operations not performed by processor 1602 quickly enough for special purposes. Examples of ASICs include graphics accelerator cards for generating images for display 1614, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 1600 also includes one or more instances of a communications interface 1670 coupled to bus 1610. Communication interface 1670 provides a one-way or two-way communication coupling to a variety of external devices that operate with their own processors, such as printers, scanners and external disks. In general the coupling is with a network link 1678 that is connected to a local network 1680 to which a variety of external devices with their own processors are connected. For example, communication interface 1670 may be a parallel port or a serial port or a universal serial bus (USB) port on a personal computer. In some embodiments, communications interface 1670 is an integrated services digital network (ISDN) card or a digital subscriber line (DSL) card or a telephone modem that provides an information communication connection to a corresponding type of telephone line. In some embodiments, a communication interface 1670 is a cable modem that converts signals on bus 1610 into signals for a communication connection over a coaxial cable or into optical signals for a communication connection over a fiber optic cable. As another example, communications interface 1670 may be a local area network (LAN) card to provide a data communication connection to a compatible LAN, such as Ethernet. Wireless links may also be implemented. For wireless links, the communications interface 1670 sends or receives or both sends and receives electrical, acoustic or electromagnetic signals, including infrared and optical signals, that carry information streams, such as digital data. For example, in wireless handheld devices, such as mobile telephones like cell phones, the communications interface 1670 includes a radio band electromagnetic transmitter and receiver called a radio transceiver. In certain embodiments, the communications interface 1670 enables connection to the communication network 107 for predicting starting points and/or ending points for traffic jams in one or more travel segments to the UE 101.

The term "computer-readable medium" as used herein refers to any medium that participates in providing information to processor 1602, including instructions for execution. Such a medium may take many forms, including, but not limited to computer-readable storage medium (e.g., non-volatile media, volatile media), and transmission media. Non-transitory media, such as non-volatile media, include, for example, optical or magnetic disks, such as storage device 1608. Volatile media include, for example, dynamic memory 1604. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

Logic encoded in one or more tangible media includes one or both of processor instructions on a computer-readable storage media and special purpose hardware, such as ASIC 1620.

Network link 1678 typically provides information communication using transmission media through one or more networks to other devices that use or process the information. For example, network link 1678 may provide a connection through local network 1680 to a host computer 1682 or to equipment 1684 operated by an Internet Service Provider (ISP). ISP equipment 1684 in turn provides data communication services through the public, world-wide packet-switching communication network of networks now commonly referred to as the Internet 1690.

A computer called a server host 1692 connected to the Internet hosts a process that provides a service in response to information received over the Internet. For example, server host 1692 hosts a process that provides information representing video data for presentation at display 1614. It is contemplated that the components of system 1600 can be deployed in various configurations within other computer systems, e.g., host 1682 and server 1692.

At least some embodiments of the invention are related to the use of computer system 1600 for implementing some or all of the techniques described herein. According to one embodiment of the invention, those techniques are performed by computer system 1600 in response to processor 1602 executing one or more sequences of one or more processor instructions contained in memory 1604. Such instructions, also called computer instructions, software and program code, may be read into memory 1604 from another computer-readable medium such as storage device 1608 or network link 1678. Execution of the sequences of instructions contained in memory 1604 causes processor 1602 to perform one or more of the method steps described herein. In alternative embodiments, hardware, such as ASIC 1620, may be used in place of or in combination with software to implement the invention. Thus, embodiments of the invention are not limited to any specific combination of hardware and software, unless otherwise explicitly stated herein.

The signals transmitted over network link 1678 and other networks through communications interface 1670, carry information to and from computer system 1600. Computer system 1600 can send and receive information, including program code, through the networks 1680, 1690 among others, through network link 1678 and communications interface 1670. In an example using the Internet 1690, a server host 1692 transmits program code for a particular application, requested by a message sent from computer 1600, through Internet 1690, ISP equipment 1684, local network 1680 and communications interface 1670. The received code may be executed by processor 1602 as it is received, or may be stored in memory 1604 or in storage device 1608 or any other non-volatile storage for later execution, or both. In this manner, computer system 1600 may obtain application program code in the form of signals on a carrier wave.

Various forms of computer readable media may be involved in carrying one or more sequence of instructions or data or both to processor 1602 for execution. For example, instructions and data may initially be carried on a magnetic disk of a remote computer such as host 1682. The remote computer loads the instructions and data into its dynamic memory and sends the instructions and data over a telephone line using a modem. A modem local to the computer system 1600 receives the instructions and data on a telephone line and uses an infra-red transmitter to convert the instructions and data to a signal on an infra-red carrier wave serving as the network link 1678. An infrared detector serving as communications interface 1670 receives the instructions and data carried in the infrared signal and places information representing the instructions and data onto bus 1610. Bus 1610 carries the information to memory 1604 from which processor 1602 retrieves and executes the instructions using some of the data sent with the instructions. The instructions and data received in memory 1604 may optionally be stored on storage device 1608, either before or after execution by the processor 1602.

FIG. 17 illustrates a chip set or chip 1700 upon which an embodiment of the invention may be implemented. Chip set 1700 is programmed to predict starting points and/or ending points for traffic jams in one or more travel segments as described herein and includes, for instance, the processor and memory components described with respect to FIG. 16 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 1700 can be implemented in a single chip. It is further contemplated that in certain embodiments the chip set or chip 1700 can be implemented as a single "system on a chip." It is further contemplated that in certain embodiments a separate ASIC would not be used, for example, and that all relevant functions as disclosed herein would be performed by a processor or processors. Chip set or chip 1700, or a portion thereof, constitutes a means for performing one or more steps of providing user interface navigation information associated with the availability of functions. Chip set or chip 1700, or a portion thereof, constitutes a means for performing one or more steps of predicting starting points and/or ending points for traffic jams in one or more travel segments.

In one embodiment, the chip set or chip 1700 includes a communication mechanism such as a bus 1701 for passing information among the components of the chip set 1700. A processor 1703 has connectivity to the bus 1701 to execute instructions and process information stored in, for example, a memory 1705. The processor 1703 may include one or more processing cores with each core configured to perform independently. A multi-core processor enables multiprocessing within a single physical package. Examples of a multi-core processor include two, four, eight, or greater numbers of processing cores. Alternatively or in addition, the processor 1703 may include one or more microprocessors configured in tandem via the bus 1701 to enable independent execution of instructions, pipelining, and multithreading. The processor 1703 may also be accompanied with one or more specialized components to perform certain processing functions and tasks such as one or more digital signal processors (DSP) 1707, or one or more application-specific integrated circuits (ASIC) 1709. A DSP 1707 typically is configured to process real-world signals (e.g., sound) in real time independently of the processor 1703. Similarly, an ASIC 1709 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one embodiment, the chip set or chip 1700 includes merely one or more processors and some software and/or firmware supporting and/or relating to and/or for the one or more processors.

The processor 1703 and accompanying components have connectivity to the memory 1705 via the bus 1701. The memory 1705 includes both dynamic memory (e.g., RAM, magnetic disk, writable optical disk, etc.) and static memory (e.g., ROM, CD-ROM, etc.) for storing executable instructions that when executed perform the inventive steps described herein to predict starting points and/or ending points for traffic jams in one or more travel segments. The memory 1705 also stores the data associated with or generated by the execution of the inventive steps.

Figure 18:
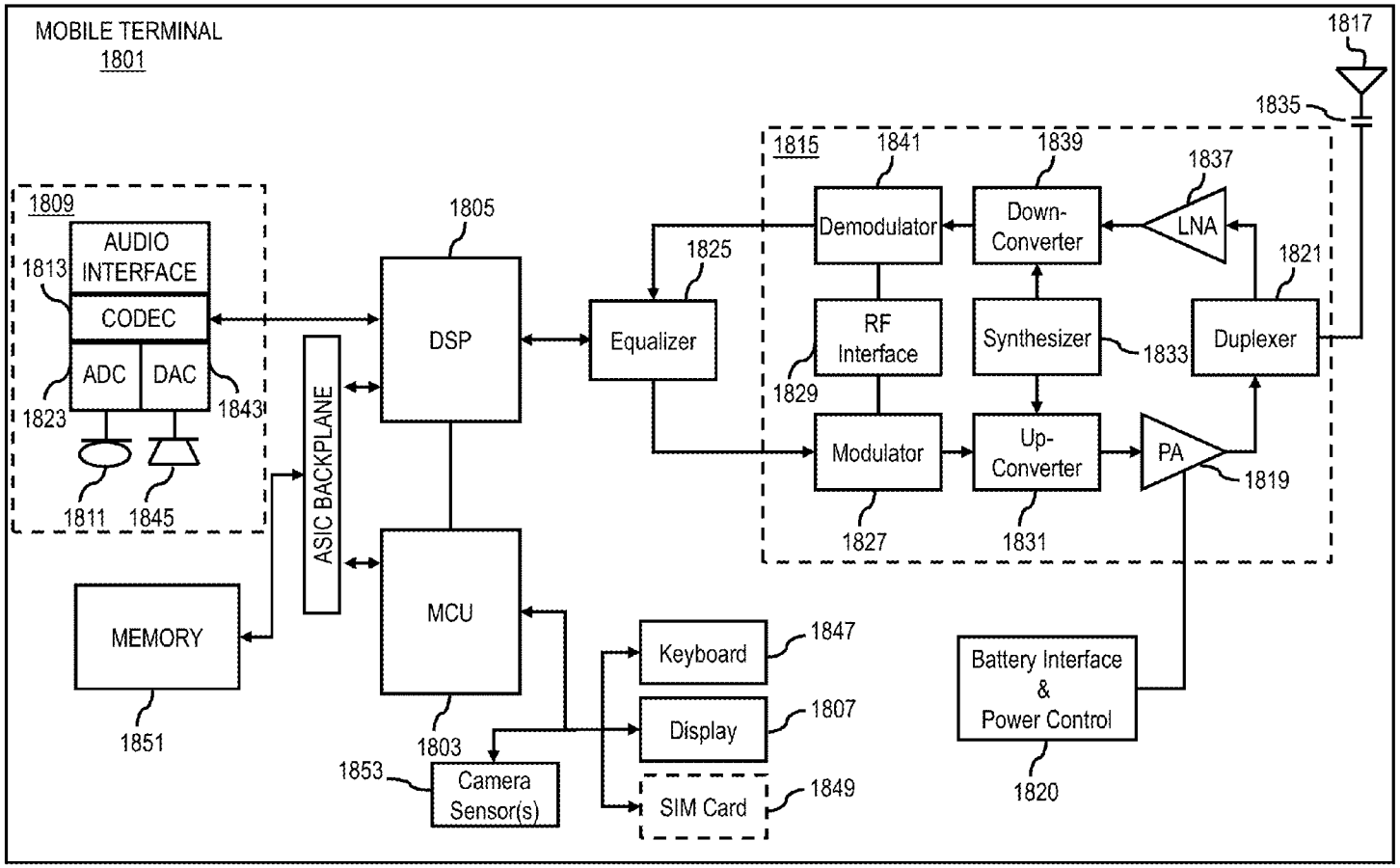
FIG. 18 is a diagram of a mobile terminal (e.g., handset) that can be used to implement an embodiment of the invention.

FIG. 18 is a diagram of exemplary components of a mobile terminal (e.g., handset) for communications, which is capable of operating in the system of FIG. 1, according to one embodiment. In some embodiments, mobile terminal 1801, or a portion thereof, constitutes a means for performing one or more steps of predicting starting points and/or ending points for traffic jams in one or more travel segments. Generally, a radio receiver is often defined in terms of front-end and back-end characteristics. The front-end of the receiver encompasses all of the Radio Frequency (RF) circuitry whereas the back-end encompasses all of the base-band processing circuitry. As used in this application, the term "circuitry" refers to both: (1) hardware-only implementations (such as implementations in only analog and/or digital circuitry), and (2) to combinations of circuitry and software (and/or firmware) (such as, if applicable to the particular context, to a combination of processor(s), including digital signal processor(s), software, and memory(ies) that work together to cause an apparatus, such as a mobile phone or server, to perform various functions). This definition of "circuitry" applies to all uses of this term in this application, including in any claims. As a further example, as used in this application and if applicable to the particular context, the term "circuitry" would also cover an implementation of merely a processor (or multiple processors) and its (or their) accompanying software/or firmware. The term "circuitry" would also cover if applicable to the particular context, for example, a baseband integrated circuit or applications processor integrated circuit in a mobile phone or a similar integrated circuit in a cellular network device or other network devices.

Pertinent internal components of the telephone include a Main Control Unit (MCU) 1803, a Digital Signal Processor (DSP) 1805, and a receiver/transmitter unit including a microphone gain control unit and a speaker gain control unit. A main display unit 1807 provides a display to the user in support of various applications and mobile terminal functions that perform or support the steps of predicting starting points and/or ending points for traffic jams in one or more travel segments. The display 1807 includes display circuitry configured to display at least a portion of a user interface of the mobile terminal (e.g., mobile telephone). Additionally, the display 1807 and display circuitry are configured to facilitate user control of at least some functions of the mobile terminal. An audio function circuitry 1809 includes a microphone 1811 and microphone amplifier that amplifies the speech signal output from the microphone 1811. The amplified speech signal output from the microphone 1811 is fed to a coder/decoder (CODEC) 1813.

A radio section 1815 amplifies power and converts frequency in order to communicate with a base station, which is included in a mobile communication system, via antenna 1817. The power amplifier (PA) 1819 and the transmitter/modulation circuitry are operationally responsive to the MCU 1803, with an output from the PA 1819 coupled to the duplexer 1821 or circulator or antenna switch, as known in the art. The PA 1819 also couples to a battery interface and power control unit 1820.

In use, a user of mobile terminal 1801 speaks into the microphone 1811 and his or her voice along with any detected background noise is converted into an analog voltage. The analog voltage is then converted into a digital signal through the Analog to Digital Converter (ADC) 1823. The control unit 1803 routes the digital signal into the DSP 1805 for processing therein, such as speech encoding, channel encoding, encrypting, and interleaving. In one embodiment, the processed voice signals are encoded, by units not separately shown, using a cellular transmission protocol such as enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., microwave access (WiMAX), Long Term Evolution (LTE) networks, code division multiple access (CDMA), wideband code division multiple access (WCDMA), wireless fidelity (WiFi), satellite, and the like, or any combination thereof.

The encoded signals are then routed to an equalizer 1825 for compensation of any frequency-dependent impairments that occur during transmission though the air such as phase and amplitude distortion. After equalizing the bit stream, the modulator 1827 combines the signal with a RF signal generated in the RF interface 1829. The modulator 1827 generates a sine wave by way of frequency or phase modulation. In order to prepare the signal for transmission, an up-converter 1831 combines the sine wave output from the modulator 1827 with another sine wave generated by a synthesizer 1833 to achieve the desired frequency of transmission. The signal is then sent through a PA 1819 to increase the signal to an appropriate power level. In practical systems, the PA 1819 acts as a variable gain amplifier whose gain is controlled by the DSP 1805 from information received from a network base station. The signal is then filtered within the duplexer 1821 and optionally sent to an antenna coupler 1835 to match impedances to provide maximum power transfer. Finally, the signal is transmitted via antenna 1817 to a local base station. An automatic gain control (AGC) can be supplied to control the gain of the final stages of the receiver. The signals may be forwarded from there to a remote telephone which may be another cellular telephone, any other mobile phone or a land-line connected to a Public Switched Telephone Network (PSTN), or other telephony networks.

Voice signals transmitted to the mobile terminal 1801 are received via antenna 1817 and immediately amplified by a low noise amplifier (LNA) 1837. A down-converter 1839 lowers the carrier frequency while the demodulator 1841 strips away the RF leaving only a digital bit stream. The signal then goes through the equalizer 1825 and is processed by the DSP 1805. A Digital to Analog Converter (DAC) 1843 converts the signal and the resulting output is transmitted to the user through the speaker 1845, all under control of a Main Control Unit (MCU) 1803 which can be implemented as a Central Processing Unit (CPU).

The MCU 1803 receives various signals including input signals from the keyboard 1847. The keyboard 1847 and/or the MCU 1803 in combination with other user input components (e.g., the microphone 1811) comprise a user interface circuitry for managing user input. The MCU 1803 runs a user interface software to facilitate user control of at least some functions of the mobile terminal 1801 to predict starting points and/or ending points for traffic jams in one or more travel segments. The MCU 1803 also delivers a display command and a switch command to the display 1807 and to the speech output switching controller, respectively. Further, the MCU 1803 exchanges information with the DSP 1805 and can access an optionally incorporated SIM card 1849 and a memory 1851. In addition, the MCU 1803 executes various control functions required of the terminal. The DSP 1805 may, depending upon the implementation, perform any of a variety of conventional digital processing functions on the voice signals. Additionally, DSP 1805 determines the background noise level of the local environment from the signals detected by microphone 1811 and sets the gain of microphone 1811 to a level selected to compensate for the natural tendency of the user of the mobile terminal 1801.

The CODEC 1813 includes the ADC 1823 and DAC 1843. The memory 1851 stores various data including call incoming tone data and is capable of storing other data including music data received via, e.g., the global Internet. The software module could reside in RAM memory, flash memory, registers, or any other form of writable storage medium known in the art. The memory device 1851 may be, but not limited to, a single memory, CD, DVD, ROM, RAM, EEPROM, optical storage, magnetic disk storage, flash memory storage, or any other non-volatile storage medium capable of storing digital data.

An optionally incorporated SIM card 1849 carries, for instance, important information, such as the cellular phone number, the carrier supplying service, subscription details, and security information. The SIM card 1849 serves primarily to identify the mobile terminal 1801 on a radio network. The card 1849 also contains a memory for storing a personal telephone number registry, text messages, and user specific mobile terminal settings.

Further, one or more camera sensors 1853 may be incorporated onto the mobile station 1801 wherein the one or more camera sensors may be placed at one or more locations on the mobile station. Generally, the camera sensors may be utilized to capture, record, and cause to store one or more still and/or moving images (e.g., videos, movies, etc.) which also may comprise audio recordings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order. The methods and systems (including steps and components thereof) can be mixed, matched, and/or rearranged. Additionally more, fewer, or different method steps or device/system components may be provided with less, more or different steps.

What is claimed is:

1. A computer-implemented method for automated detection of at least one traffic jam from probe data comprising:

collecting the probe data by a location sensor of one or more vehicles travelling on at least one travel segment, wherein the location sensor is configured to sense speed information of the one or more vehicles to report as part of the probe data;

processing the probe data to generate at least one speed curve with respect to a distance dimension and a time dimension, wherein the at least one speed curve indicates at least one previous starting point, at least one previous ending point, or a combination thereof for one or more previous traffic jams based on the speed information;

processing the at least one previous starting point, the at least one previous ending point, or a combination thereof to determine at least one starting point trend curve, at least one ending point trend curve, or a combination thereof with respect to the distance dimension and the time dimension; and determining at least one predicted evolution of at least one starting point, at least one ending point, or a combination thereof for the at least one traffic jam in the at least one travel segment based on the at least one starting point trend curve, the at least one ending point trend curve, or a combination thereof.

2. A method of claim 1, further comprising:

causing, at least in part, an initiation of the determination of the at least one predicted evolution after a collection of one or more data points of the at least one observed starting point, the at least one observed ending point, or a combination thereof.

3. A method of claim 1, further comprising:

determining the at least one starting point trend curve, the at least one ending point trend curve, or a combination thereof to use based, at least in part, on a curve-fitting of the at least one observed starting point, the at least one observed ending point, or a combination thereof.

4. A method of claim 3, further comprising:

determining that there is not a difference above a threshold value between the one or more data points and one or more predicted starting points, one or more predicted ending points, or a combination thereof that are predicted from the at least one starting point trend curve, the at least one ending point trend curve, or a combination thereof; and causing, at least in part, an adjustment of the curve-fitting based, at least in part, on the one or more data points.

5. A method of claim 3, further comprising:

determining that there is a difference above a threshold value between the one or more data points and one or more predicted starting points, one or more predicted ending points, or a combination thereof that are predicted from the at least one starting point trend curve, the at least one ending point trend curve, or a combination thereof; and causing, at least in part, an invalidation of the at least one starting point trend curve, the at least one ending point trend curve, or a combination thereof.

6. A method of claim 1, further comprising:

causing, at least in part, a partitioning of the at least one travel segment into one or more sections based, at least in part, on the distance dimension, wherein the generation of the at least one speed curve is based, at least in part, on the one or more sections.

7. A method of claim 1, further comprising:

causing, at least in part, a sorting of the probe data along the time dimension using at least one time window, wherein the at least one time window is associated respectively with the at least one speed curve.

8. A method of claim 7, further comprising:

specifying at least one time increment for moving from a first one of the at least one time window to a second one of the time window for generating the at least one speed curve.

9. A method of claim 1, further comprising:

determining the at least one previous starting point, the at least one previous ending point, the at least one starting point, the at least one ending point, or a combination thereof by comparing against at least one jam threshold value.

10. A method of claim 9, wherein the determining of the at least one previous starting point, the at least one previous ending point, the at least one starting point, the at least one ending point, or a combination thereof is further based, at least in part, on at least one noise tolerance value, and wherein the at least one noise tolerance represents a threshold number of consecutive observations to make before the determining of the at least one previous starting point, the at least one previous ending point, the at least one starting point, the at least one ending point, or a combination thereof is made.

11. An apparatus comprising:

at least one processor; and at least one memory including computer program code for one or more programs, the at least one memory and the computer program code configured to, with the at least one processor, cause the apparatus to perform at least the following, process and/or facilitate a processing of probe data associated with at least one travel segment to cause, at least in part, a generation of at least one speed curve with respect to a distance dimension and a time dimension, wherein the probe data includes speed information, and wherein the at least one speed curve indicates at least one previous starting point, at least one previous ending point, or a combination thereof for one or more previous traffic jams based, at least in part, on the speed information;

process and/or facilitate a processing of the at least one previous starting point, the at least one previous ending point, or a combination thereof to determine at least one starting point trend curve, at least one ending point trend curve, or a combination thereof with respect to the distance dimension and the time dimension; and determining at least one predicted evolution of at least one starting point, at least one ending point, or a combination thereof for at least one traffic jam in the at least one travel segment based, at least in part, on the at least one starting point trend curve, the at least one ending point trend curve, or a combination thereof.

12. An apparatus of claim 11, wherein the apparatus is further caused to:

cause, at least in part, an initiation of the determination of the at least one predicted evolution after a collection of one or more data points of the at least one observed starting point, the at least one observed ending point, or a combination thereof.

13. An apparatus of claim 11, wherein the apparatus is further caused to:

determine the at least one starting point trend curve, the at least one ending point trend curve, or a combination thereof to use based, at least in part, on a curve-fitting of the at least one observed starting point, the at least one observed ending point, or a combination thereof.

14. An apparatus of claim 13, wherein the apparatus is further caused to:

determine that there is not a difference above a threshold value between the one or more data points and one or more predicted starting points, one or more predicted ending points, or a combination thereof that are predicted from the at least one starting point trend curve, the at least one ending point trend curve, or a combination thereof; and cause, at least in part, an adjustment of the curve-fitting based, at least in part, on the one or more data points.

15. An apparatus of claim 13, wherein the apparatus is further caused to:

determine that there is a difference above a threshold value between the one or more data points and one or more predicted starting points, one or more predicted ending points, or a combination thereof that are predicted from the at least one starting point trend curve, the at least one ending point trend curve, or a combination thereof; and cause, at least in part, an invalidation of the at least one starting point trend curve, the at least one ending point trend curve, or a combination thereof.

16. An apparatus of claim 11, wherein the apparatus is further caused to:

cause, at least in part, a partitioning of the at least one travel segment into one or more sections based, at least in part, on the distance dimension, wherein the generation of the at least one speed curve is based, at least in part, on the one or more sections.

17. An apparatus of claim 11, wherein the apparatus is further caused to:

cause, at least in part, a sorting of the probe data along the time dimension using at least one time window, wherein the at least one time window is associated respectively with the at least one speed curve.

18. A non-transitory computer-readable storage medium carrying one or more sequences of one or more instructions which, when executed by one or more processors, cause an apparatus to at least perform the following steps:

process and/or facilitate a processing of probe data associated with at least one travel segment to cause, at least in part, a generation of at least one speed curve with respect to a distance dimension and a time dimension, wherein the probe data includes speed information, and wherein the at least one speed curve indicates at least one previous starting point, at least one previous ending point, or a combination thereof for one or more previous traffic jams based, at least in part, on the speed information;

process and/or facilitate a processing of the at least one previous starting point, the at least one previous ending point, or a combination thereof to determine at least one starting point trend curve, at least one ending point trend curve, or a combination thereof with respect to the distance dimension and the time dimension; and determining at least one predicted evolution of at least one starting point, at least one ending point, or a combination thereof for at least one traffic jam in the at least one travel segment based, at least in part, on the at least one starting point trend curve, the at least one ending point trend curve, or a combination thereof.

19. A non-transitory computer-readable storage medium of claim 18, wherein the apparatus is further caused to:

cause, at least in part, an initiation of the determination of the at least one predicted evolution after a collection of one or more data points of the at least one observed starting point, the at least one observed ending point, or a combination thereof.

20. A non-transitory computer-readable storage medium of claim 18, wherein the apparatus is further caused to:

determine the at least one starting point trend curve, the at least one ending point trend curve, or a combination thereof to use based, at least in part, on a curve-fitting of the at least one observed starting point, the at least one observed ending point, or a combination thereof.

* * * * *